US011221009B2

(12) United States Patent
Uekawa

(10) Patent No.: US 11,221,009 B2
(45) Date of Patent: Jan. 11, 2022

(54) SCROLL COMPRESSOR WITH A LUBRICATION ARRANGEMENT

(71) Applicant: Samsung Electronics Co., Ltd., Suwon-si (KR)

(72) Inventor: Takashi Uekawa, Yokohama (JP)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 16/946,663

(22) Filed: Jun. 30, 2020

(65) Prior Publication Data

US 2021/0017994 A1 Jan. 21, 2021

(30) Foreign Application Priority Data

Jul. 17, 2019 (JP) ..... JP2019-131883
Oct. 29, 2019 (JP) ..... JP2019-196648
Mar. 25, 2020 (KR) ..... 10-2020-0036150

(51) Int. Cl.
*F04C 29/02* (2006.01)
*F04C 18/02* (2006.01)
(Continued)

(52) U.S. Cl.
CPC ..... *F04C 29/02* (2013.01); *F04C 18/0215* (2013.01); *F04C 18/0253* (2013.01);
(Continued)

(58) Field of Classification Search
CPC ..... F04C 2/025; F04C 18/0207–0292; F04C 15/0088–0092; F04C 29/02–028;
(Continued)

(56) References Cited

U.S. PATENT DOCUMENTS 5,810,573 A 9/1998 Mitsunaga et al.
6,074,186 A 6/2000 Lifson et al.
(Continued)

FOREIGN PATENT DOCUMENTS

EP 3418574 A1 * 12/2018 ..... F04C 18/0261
JP 2009-013882 A 1/2009
(Continued)

OTHER PUBLICATIONS

International Search Report of the International Searching Authority in connection with International Application No. PCT/KR2020/009226 dated Nov. 3, 2020, 4 pages.

*Primary Examiner* — Laert Dounis

(57) ABSTRACT

A scroll compressor including an orbiting scroll having a small diameter compared to a case in which an oil groove is provided in a ring shape and constantly communicates with an outlet of an oil passage. The scroll compressor includes a fixed scroll and an orbiting scroll configured to orbit in engagement with the fixed scroll. The fixed scroll includes an outlet of an oil passage configured to communicate with an oil tray storing lubricant, the outlet of the oil passage connected to a sliding surface of the orbiting scroll. The orbiting scroll includes a plurality of oil grooves configured not to communicate with each other so as to supply the lubricant to a sliding surface of the fixed scroll, the plurality of oil grooves configured to communicate with the outlet at least once and not to communicate with the outlet at least once while the orbiting scroll rotates once.

20 Claims, 16 Drawing Sheets

(51) Int. Cl.

| | |
|---|---|
| ***F25B 1/047*** | (2006.01) |
| ***F25B 31/00*** | (2006.01) |
| ***F25B 31/02*** | (2006.01) |
| ***F04C 23/00*** | (2006.01) |

(52) U.S. Cl.
CPC ..... *F25B 1/047* (2013.01); *F25B 31/002* (2013.01); *F25B 31/026* (2013.01); *F04C 23/008* (2013.01); *F04C 2240/20* (2013.01); *F05B 2260/98* (2013.01)

(58) Field of Classification Search
CPC .... F01C 1/0207–0292; F01C 21/04–45; F01C 21/04–045
See application file for complete search history.

(56) References Cited

U.S. PATENT DOCUMENTS

| | | | | |
|---|---|---|---|---|
| 2006/0210416 | A1 | 9/2006 | Morimoto et al. | |
| 2010/0092321 | A1 | 4/2010 | Kim et al. | |
| 2013/0209303 | A1* | 8/2013 | Tsuka | F04C 23/008 418/55.1 |
| 2014/0010694 | A1* | 1/2014 | Tsuka | F04C 18/02 418/55.2 |
| 2014/0017108 | A1* | 1/2014 | Uekawa | F04C 23/008 418/55.1 |

FOREIGN PATENT DOCUMENTS

| | | | |
|---|---|---|---|
| JP | 5386566 | B2 | 1/2014 |
| JP | 5765379 | B2 | 8/2015 |
| KR | 10-2011-0064663 | A | 6/2011 |
| KR | 10-1480464 | B1 | 1/2015 |

* cited by examiner

SCROLL COMPRESSOR WITH A LUBRICATION ARRANGEMENT

CROSS-REFERENCE TO RELATED APPLICATIONS

This application claims priority to Japanese Patent Application Nos. 2019-131883 and 2019-196648 respectively filed on Jul. 17, 2019 and Oct. 29, 2019 in the Japan Patent Office, and Korean Patent Application No. 10-2020-0036150, filed on Mar. 25, 2020 in the Korean Intellectual Property Office, the disclosures of which are incorporated herein by reference.

BACKGROUND

1. Field

The disclosure relates to a scroll compressor.

2. Description of Related Art

A scroll compressor is disclosed (refer to patent document 1). The scroll compressor includes a compression device including a fixed scroll and an orbiting scroll, and a drive shaft engaged with the orbiting scroll. An oil groove is formed on an orbiting side thrust sliding surface of the orbiting scroll or a fixed side thrust sliding surface of the fixed scroll. The scroll compressor further includes a bearing oil supply passage configured to supply a lubricant of an oil tray in a casing to a bearing of the drive shaft and configured not to communicate with the oil groove, and an oil supply passage for sliding surface configured to supply a lubricant of the oil tray to the oil groove. The oil supply passage for the sliding surface includes a main passage for sliding surface provided in the drive shaft.

PATENT DOCUMENTS

Patent document 1: Japanese Patent Publication No. 5765379

SUMMARY

As for a scroll compressor, a fixed scroll includes an outlet of an oil passage that is provided on a sliding surface of the fixed scroll facing an orbiting scroll and configured to communicate with an oil tray, and the orbiting scroll includes an oil groove provided on a sliding surface of the orbiting scroll facing the fixed scroll. The oil groove is installed to communicate with the outlet of the oil passage. Particularly, the oil groove may be provided in one ring shape, and configured to communicate with the outlet of the oil passage all the time. In this case, when a diameter of the orbiting scroll becomes relatively small, the oil groove may communicate with a compression chamber while the orbiting scroll rotates once. When the oil groove communicates with the compression chamber, a lubricant may flow from the oil groove to the compression chamber. Accordingly, the efficiency and reliability of the scroll compressor may be significantly reduced. Therefore, it is hard to make the diameter of the orbiting scroll small.

In addition, as for a scroll compressor, a fixed scroll includes an outlet of an oil passage that is provided on a sliding surface of the fixed scroll facing an orbiting scroll and configured to communicate with an oil tray, and the orbiting scroll includes an oil groove provided on a sliding surface of the orbiting scroll facing the fixed scroll. The oil groove is installed to communicate with the outlet of the oil passage. Particularly, the oil groove may be provided in one ring shape, and configured to communicate with the outlet of the oil passage all the time. In this case, when a diameter of the orbiting scroll becomes relatively small, the oil groove may communicate with an intermediate pressure chamber while the orbiting scroll rotates once. When the oil groove communicates with the intermediate pressure chamber, a lubricant may flow from the oil groove to the intermediate pressure chamber. Accordingly, the efficiency and reliability of the scroll compressor may be significantly reduced because the lubricant does not flow to the oil tray. Therefore, it is hard to make the diameter of the orbiting scroll small.

Therefore, it is an aspect of the present disclosure to provide a scroll compressor including an orbiting scroll having a small diameter in comparison with a case in which an oil groove is provided in a single ring shape and the oil groove constantly communicates with an outlet of an oil passage.

Additional aspects of the present disclosure will be set forth in part in the description which follows and, in part, will be obvious from the description, or may be learned by practice of the present disclosure.

In accordance with an aspect of the disclosure, a scroll compressor includes a fixed scroll fixed to an inside of a main body, and an orbiting scroll configured to orbit in engagement with the fixed scroll, and the fixed scroll includes an outlet of an oil passage configured to communicate with an oil tray configured to store a lubricant, the outlet of the oil passage connected to a sliding surface of the orbiting scroll, and the orbiting scroll includes a plurality of oil grooves configured to supply the lubricant to a sliding surface of the fixed scroll and configured not to communicate with each other, and the plurality of oil grooves is configured to communicate with the outlet at least once and not to communicate with the outlet at least once while the orbiting scroll rotates once.

The plurality of oil grooves may be sealed by a sliding surface of the fixed scroll and the sliding surface of the orbiting scroll while being in communication with the outlet.

Among the plurality of oil grooves, one oil groove may communicate with the outlet during a time in which at least one oil groove except the one oil groove does not communicate with the outlet.

The one oil groove and the at least one oil groove may be sealed by the sliding surface of the fixed scroll and the sliding surface of the orbiting scroll.

A distance of a portion in which the one oil groove is sealed by the sliding surface of the fixed scroll and the sliding surface of the orbiting scroll may be greater than a distance of a portion in which the at least one oil groove is sealed by the sliding surface of the fixed scroll and the sliding surface of the orbiting scroll during the time in which the at least one oil groove does not communicate with the outlet.

The scroll compressor may further include a compression chamber formed between the fixed scroll and the orbiting scroll and having a volume that is changeable as the orbiting scroll orbits with respect to the fixed scroll.

A distance from the one oil groove to the compression chamber may be greater than a distance from the at least one oil groove to the compression chamber.

At least a portion of each of the plurality of oil grooves may extend along the outer circumference of the orbiting scroll.

The outlet may be provided in plural in accordance with the number of the plurality of oil grooves.

At a first predetermined timing while the orbiting scroll rotates once, the at least one oil groove of the plurality of oil grooves may communicate with the outlet and other at least one oil groove except the at least one oil groove may not communicate with the outlet.

The at least one oil groove and the other at least one oil groove may be sealed by the sliding surface of the fixed scroll and the sliding surface of the orbiting scroll at the first predetermined timing.

At the first predetermined timing, a distance of a portion in which the at least one oil groove is sealed by the sliding surface of the fixed scroll and the sliding surface of the orbiting scroll may be greater than a distance of a portion in which the other at least one oil groove is sealed by the sliding surface of the fixed scroll and the sliding surface of the orbiting scroll.

At a second predetermined timing while the orbiting scroll rotates once, the plurality of oil grooves may not communicate with the outlet.

In accordance with another aspect of the disclosure, an air conditioner includes a scroll compressor configured to compress refrigerants, an outdoor heat exchanger configured to exchange heat with the outside air, an expansion device configured to expand the refrigerant, and an indoor heat exchanger configured to exchange heat with the indoor air, and the scroll compressor includes a fixed scroll fixed to an inside of a main body and an orbiting scroll configured to orbit in engagement with the fixed scroll, and the fixed scroll includes an outlet of an oil passage configured to communicate with an oil tray configured to store a lubricant, the outlet of the oil passage connected to a sliding surface of the orbiting scroll, and the orbiting scroll includes a plurality of oil grooves configured to supply the lubricant to a sliding surface of the fixed scroll and configured not to communicate with each other, and the plurality of oil grooves is configured to communicate with the outlet at least once and configured not to communicate with the outlet at least once while the orbiting scroll rotates once.

In accordance with another aspect of the disclosure, a scroll compressor includes a fixed scroll fixed to an inside of a main body and an orbiting scroll configured to orbit in engagement with the fixed scroll, and the fixed scroll includes a first outlet and a second outlet of an oil passage configured to connect an oil tray configured to store a lubricant to a sliding surface of the orbiting scroll, and the orbiting scroll includes a first oil groove and a second oil groove configured to distribute the lubricant to a sliding surface of the fixed scroll and configured not to communicate with each other, and the first oil groove and the second oil groove include a first state in which the first oil groove communicates with the first outlet and the second oil grooves does not communicate with the first outlet and the second outlet while the orbiting scroll rotates once, and a second state in which the second oil groove communicates with the second outlet and the first oil grooves does not communicate with the first outlet and the second outlet while the orbiting scroll rotates once.

In accordance with another aspect of the disclosure, a scroll compressor includes a fixed scroll fixed to an inside of a main body, and an orbiting scroll configured to orbit in engagement with the fixed scroll, and the fixed scroll includes a plurality of oil grooves configured to distribute a lubricant to a sliding surface of the orbiting scroll and configured not to communicate with each other, and the orbiting scroll includes an outlet of an oil passage configured to allow a sliding surface of the fixed scroll to communicate with an oil tray configured to store the lubricant, and the plurality of oil grooves is configured to communicate with the outlet at least once and configured not to communicate with the outlet at least once while the orbiting scroll rotates once.

Each of the plurality of oil grooves may be sealed by the sliding surface of the fixed scroll and the sliding surface of the orbiting scroll while being in communication with the outlet.

Among the plurality of oil grooves, one oil groove may communicate with the outlet during a time in which at least one oil groove except the one oil groove does not communicate with the outlet.

The one oil groove and the at least one oil groove may be sealed by the sliding surface of the fixed scroll and the sliding surface of the orbiting scroll.

A distance of a portion in which the one oil groove is sealed by the sliding surface of the fixed scroll and the sliding surface of the orbiting scroll may be greater than a distance of a portion in which the at least one oil groove is sealed by the sliding surface of the fixed scroll and the sliding surface of the orbiting scroll during the time in which the at least one oil groove does not communicate with the outlet.

In accordance with another aspect of the disclosure, a scroll compressor includes a fixed scroll fixed to an inside of a main body, and an orbiting scroll configured to orbit in engagement with the fixed scroll, and the fixed scroll includes an outlet of an oil passage configured to communicate with an oil tray configured to store a lubricant, the outlet of the oil passage connected to a sliding surface of the orbiting scroll, and the orbiting scroll includes a plurality of oil grooves configured to supply the lubricant to the sliding surface of the fixed scroll and configured not to communicate with each other, and the plurality of oil grooves is configured to communicate with the outlet at least once and not to communicate with the outlet at least once while the orbiting scroll rotates once.

While being in communication with the outlet, the plurality of oil grooves may be sealed by a sliding surface of the fixed scroll and the sliding surface of the orbiting scroll.

Among the plurality of oil grooves, one oil groove may communicate with the outlet during a time in which at least one oil groove except the one oil groove does not communicate with the outlet.

The one oil groove and the at least one oil groove may be sealed by a sliding surface of the fixed scroll and the sliding surface of the orbiting scroll.

A distance of a portion in which the one oil groove is sealed by the sliding surface of the fixed scroll and the sliding surface of the orbiting scroll may be greater than a distance of a portion in which the at least one oil groove is sealed by the sliding surface of the fixed scroll and the sliding surface of the orbiting scroll during the time in which the at least one oil groove does not communicate with the outlet.

In accordance with another aspect of the disclosure, a scroll compressor includes a fixed scroll fixed to an inside of a main body, and an orbiting scroll configured to orbit in engagement with the fixed scroll, and the fixed scroll includes an outlet of an oil passage provided on a sliding surface in the orbiting scroll side and configured to communicate with an oil tray configured to store a lubricant, and the orbiting scroll includes a plurality of oil grooves configured to supply the lubricant to a sliding surface in the fixed scroll side and configured not to communicate with each other, and the plurality of oil grooves is configured to communicate with the outlet at least once and not to communicate with the outlet at a predetermined time while the orbiting scroll rotates once.

The at least one oil groove and the other at least one oil groove may be sealed by the sliding surface of the fixed scroll and the sliding surface of the orbiting scroll at the predetermined timing.

A distance of a portion in which the at least one oil groove is sealed by the sliding surface of the fixed scroll and the sliding surface of the orbiting scroll may be greater than a distance of a portion in which the other at least one oil groove is sealed by the sliding surface of the fixed scroll and the sliding surface of the orbiting scroll at the predetermined timing.

In accordance with another aspect of the disclosure, a scroll compressor includes a fixed scroll fixed to an inside of a main body and an orbiting scroll configured to orbit in engagement with the fixed scroll, and the fixed scroll includes a first outlet and a second outlet of an oil passage configured to connect an oil tray configured to store a lubricant to a sliding surface of the orbiting scroll, and the orbiting scroll includes a first oil groove and a second oil groove configured to distribute the lubricant to a sliding surface of the fixed scroll and configured not to communicate with each other, and the first oil groove and the second oil groove include a first state in which the first oil groove communicates with the first outlet and the second oil grooves does not communicate with the first outlet and the second outlet while the orbiting scroll rotates once, and a second state in which the second oil groove communicates with the second outlet and the first oil grooves does not communicate with the first outlet and the second outlet while the orbiting scroll rotates once.

In the first state, the first oil groove may be sealed by the sliding surface of the fixed scroll and the sliding surface of the orbiting scroll.

In the second state, the second oil groove may be sealed by the sliding surface of the fixed scroll and the sliding surface of the orbiting scroll.

In the first and second state, the first and second oil groove may be sealed by the sliding surface of the fixed scroll and the sliding surface of the orbiting scroll.

A distance of a portion in which the first oil groove is sealed by the sliding surface of the fixed scroll and the sliding surface of the orbiting scroll may be greater than a distance of a portion in which the second oil groove is sealed by the sliding surface of the fixed scroll and the sliding surface of the orbiting scroll in the first state.

A distance of a portion in which the second oil groove is sealed by the sliding surface of the fixed scroll and the sliding surface of the orbiting scroll may be greater than a distance of a portion in which the first oil groove is sealed by the sliding surface of the fixed scroll and the sliding surface of the orbiting scroll in the second state.

In accordance with another aspect of the disclosure, a scroll compressor includes a fixed scroll fixed to an inside of a main body, and an orbiting scroll configured to orbit in engagement with the fixed scroll, and the fixed scroll includes a plurality of oil grooves configured to supply the lubricant to the sliding surface of the orbiting scroll and configured not to communicate with each other, and the orbiting scroll comprises an outlet of an oil passage configured to allow an oil tray configured to store a lubricant to communicate with a sliding surface of the fixed scroll, and the plurality of oil grooves is configured to communicate with the outlet at least once and not to communicate with the outlet at least once while the orbiting scroll rotates once.

The plurality of oil grooves may be sealed by a sliding surface of the fixed scroll and the sliding surface of the orbiting scroll while being in communication with the outlet.

Among the plurality of oil grooves, one oil groove may communicate with the outlet during a time in which at least one oil groove except the one oil groove does not communicate with the outlet.

The one oil groove and the at least one oil groove may be sealed by the sliding surface of the fixed scroll and the sliding surface of the orbiting scroll.

A distance of a portion in which the one oil groove is sealed by the sliding surface of the fixed scroll and the sliding surface of the orbiting scroll may be greater than a distance of a portion in which the at least one oil groove is sealed by the sliding surface of the fixed scroll and the sliding surface of the orbiting scroll during the time in which the at least one oil groove does not communicate with the outlet.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely.

Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

These and/or other aspects of the disclosure will become apparent and more readily appreciated from the following description of embodiments, taken in conjunction with the accompanying drawings of which.

DETAILED DESCRIPTION

FIGS. 1 through 16, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system or device.

Hereinafter embodiments of the disclosure will be described in detail with reference to the accompanying drawings.

As for a scroll compressor having a structure in which an orbiting scroll is pressed against a fixed scroll to seal a compression chamber, lubrication at a sliding portion between a surface of a spiral body of an end plate of the orbiting scroll and a surface of a spiral body of an end plate of the fixed scroll may be important to improve performance and reliability of the scroll compressor. Further, because a diameter of the end plate of the orbiting scroll is significantly related to the size of the compressor, reducing the diameter of the end plate of the orbiting scroll may be directly related to reducing the size of the compressor, and thus the reduction of the diameter may cause the reduction of cost. However, the reduction in the diameter of the orbiting scroll may cause difficulty in obtaining appropriate lubrication in the sliding portion.

The disclosure is intended to relieve this difficulty in the sliding portion, and particularly, to obtain appropriate sealing force and appropriate lubrication with a relatively small diameter of the orbiting scroll.

Figure 1:
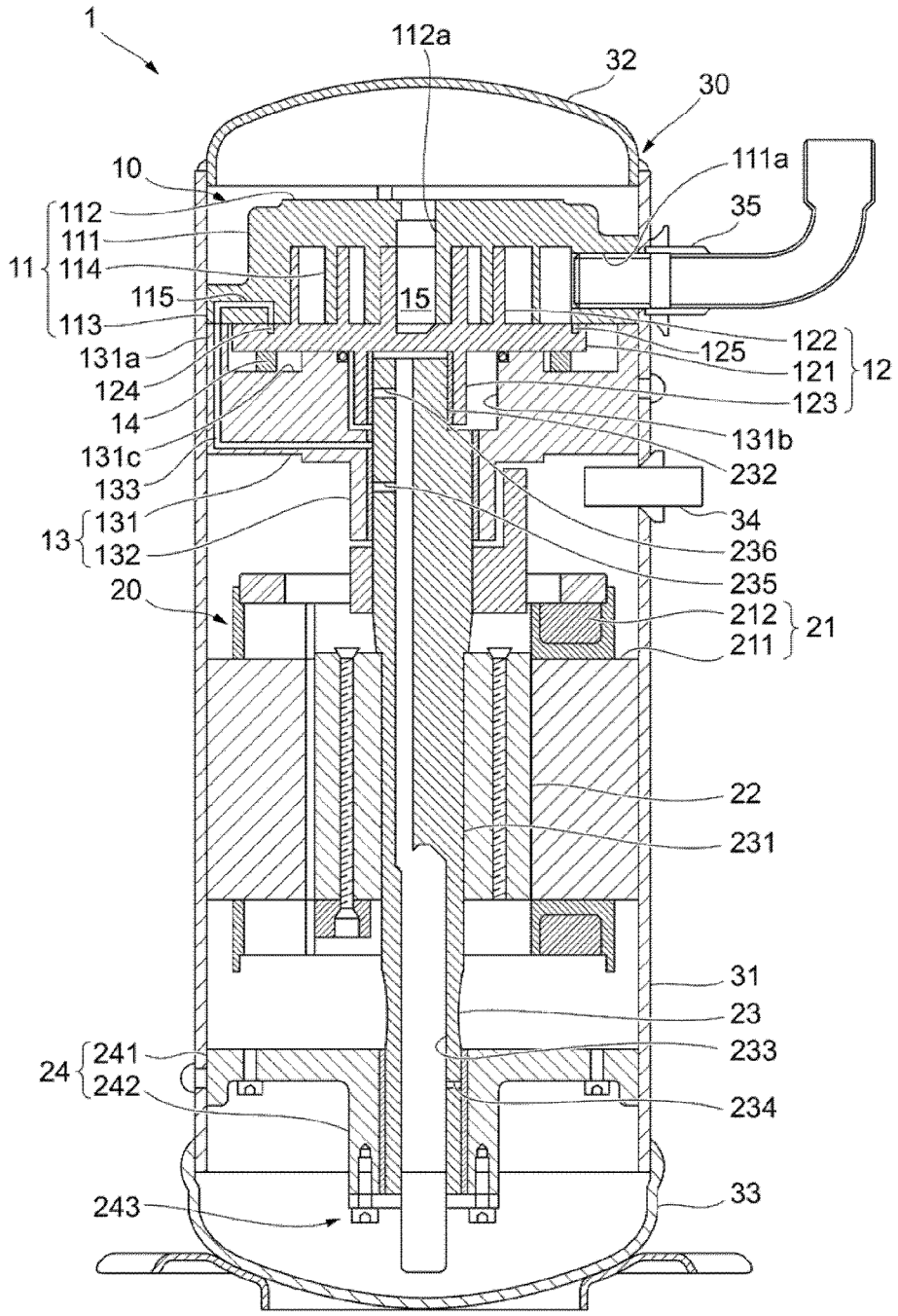
FIG. 1 is an axial cross-sectional view of a scroll compressor according to an embodiment of the disclosure.

FIG. 1 is an axial cross-sectional view of a scroll compressor 1 according to an embodiment of the disclosure.

The scroll compressor 1 is a compressor widely used for an air conditioner, a freezer, and a heat pump. FIG. 1 is a longitudinal sectional view of a hermetic scroll compressor used in a refrigerant circuit of an air conditioner.

The scroll compressor 1 includes a compression portion 10 configured to compress a refrigerant, a drive motor 20 configured to drive the compression portion 10, and a casing 30 corresponding to a housing configured to receive the compression portion 10 and the drive motor 20. According to an embodiment, the scroll compressor 1 is a vertical scroll compressor in which an axial direction of a rotary shaft 23, which will be described later, of the drive motor 20 is coincident with the gravity direction. Hereinafter the axial direction of the rotary shaft 23 will be referred to as "vertical direction", and based on FIG. 1, upward may be referred to as "upper side" and downward may be referred to as "lower side". Although the vertical scroll compressor is described as an example, but the embodiment of the disclosure will be applicable to a horizontal scroll compressor.

First, the compression portion 10 will be described.

The compression portion 10 includes a fixed scroll 11 fixed to the casing 30, an orbiting scroll 12 configured to orbit in engagement with the fixed scroll 11, a frame 13 configured to support the fixed scroll 11 while being fixed to the casing 30, and an Oldham ring 14 configured to allow the orbiting scroll 12 to orbit while preventing the orbiting scroll 12 from pivoting.

The fixed scroll 11 includes a cylindrical portion 111 having a cylindrical shape, an end plate 112 configured to cover an opening in an upper side of the cylindrical portion 111, and a protrusion 113 extending from a lower end of the cylindrical portion 111 in radially outward direction. Further, the fixed scroll 11 includes a fixed side spiral body 114 extending downward from a lower end of the end plate 112 and having a spiral shape when viewed from below. The fixed scroll 11 may be formed of cast iron such as gray iron FC 250.

The cylindrical portion 111 is provided with a through hole 111*a* in the radial direction. The though hole 111*a* may serve as a suction port configured to suction the refrigerant into a space surrounded by the cylindrical portion 111, the end plate 112 and the orbiting scroll 12.

Further, an oil passage 115 that is curved in an inverted U shape is also formed in the cylindrical portion 111.

A through hole 112*a* in the vertical direction is formed at the center of the end plate 112. The through hole 112*a* may serve as a discharge port configured to discharge the refrigerant from the space surrounded by the end plate 112, the fixed side spiral body 114 and the orbiting scroll 12.

The fixed scroll 11 constructed as described above is fixed to the frame 13 by a positioning means such as a bolt or a positioning pin passed through the through hole in the vertical direction formed in the protrusion 113. Accordingly, an inlet of the oil passage 115 in the frame 13 side is fixed to an outlet of an oil passage 133, which is described later, in the fixed scroll 11 side.

The orbiting scroll 12 includes an end plate 121 having a disk shape, an orbiting side spiral body 122 extending upward from an upper end of the end plate 121 and having a spiral shape when viewed from above, a cylindrical portion 123 extending from a lower end of the end plate 121 downward and having a cylindrical shape. The orbiting scroll 12 may be formed of FC material or FCD material.

The end plate 121 may include a first oil groove 124 and a second oil groove 125 provided on the sliding surface in the orbiting side spiral body 122 side and configured not to communicate with each other. FIG. 1 illustrates that the outlet of the oil passage 115 communicates with the first oil groove 124.

The orbiting side spiral body 122 is a spiral body in mesh engagement with the fixed side spiral body 114 of the fixed scroll 11. The orbiting side spiral body 122 and the fixed side spiral body 114 of the fixed scroll 11 are placed in a space between the cylindrical portion 111 and the end plate 112 of the fixed scroll 11, and the end plate 121 of the orbiting scroll 12, thereby forming a compression chamber 15. Because the orbiting side spiral body 122 is circularly moved about the fixed side spiral body 114 that is fixed, a volume of the compression chamber 15 is reduced and the refrigerant of the compression chamber 15 is compressed. In other words, as an internal space between the fixed side spiral body 114 and the orbiting side spiral body 122 is reduced with respect to a center of rotation, the refrigerant is compressed.

An eccentric shaft 232 of a rotary shaft 23, which is described later, is inserted into the cylindrical portion 123 through a sliding bearing. As described above, the cylindrical portion 123 functions as a bearing of the eccentric shaft 232.

The frame 13 includes a first cylindrical portion 131 having a cylindrical shape, and a second cylindrical portion 132 extending downward from the lower end of the first cylindrical portion 131 to have a cylindrical shape. An outer circumferential surface of the first cylindrical portion 131 of the frame 13 is fixed to a central casing 31 of the casing 30, which is described later. In addition, the rotary shaft 23 of the drive motor 20, which is described later, is inserted into the inside of the first cylindrical portion 131 and the second cylindrical portion 132 using a journal bearing. As mentioned above, the frame 13 also functions as a bearing for rotatably supporting the rotary shaft 23.

In an outer circumferential portion of the first cylindrical portion 131, a protrusion 131*a* protruding upward from the upper end surface is installed. A female is formed in the protrusion 131*a*. A bolt, which passed through the through hole formed in the protrusion 131*a* of the fixed scroll 11, is engaged with the female screw. Therefore, the fixed scroll 11 may be fixed to the frame 13.

In addition, the first cylindrical portion 131 is provided with a first concave portion 131*b* and a second concave portion 131*c*, which are concave downward from the upper end surface. In the radial direction, the first concave portion 131*b* is formed at the center, and the second concave portion 131*c* is formed between the first concave portion 131*b* and the protrusion 131*a*. The cylindrical portion 123 of the orbiting scroll 12 is inserted into the first concave portion 131*b*. The Oldham ring 14, which is arranged between the frame 13 and the orbiting scroll 12 to prevent the orbiting scroll 12 from pivoting, is arranged in the second concave portion 131*c*.

In addition, the oil passage 133 having a shape that is directed radially outward from the rotating shaft 23 and then bent upwards in the protrusion 131*a* is formed in the first cylindrical portion 131. As described above, because the fixed scroll 11 is mounted on the frame 13, the outlet of the oil passage 133 in the fixed scroll 11 side is fixed to the inlet of the oil passage 115 in the frame 13 side.

The rotary shaft 23 is inserted and coupled to an inner circumference of the second cylindrical portion 132 through a journal bearing, and the second cylindrical portion 132 functions as a bearing for rotatably supporting the rotary shaft 23.

In the above-mentioned compression portion 10, a discharge passage for discharging the compressed refrigerant to the fixed scroll 11 and the orbiting scroll 12 is formed. As for the discharge passage, one end is connected to the through hole 112*a* of the end plate 112, which is configured to discharge the refrigerant from the space surrounded by the fixed scroll 11 and the orbiting scroll 12, and the other is connected to a space lower than the frame 13 in the casing 30.

Next, the drive motor 20 will be described.

The drive motor 20 is fixed to the casing 30 under the compression portion 10.

The drive motor 20 includes a stator 21 configured to constitute a stationary portion, a rotor 22 configured to constitute a rotating portion, the rotary shaft 23 configured to support the rotor 22 and configured to rotate with respect to the casing 30, and a support member 24 configured to rotatably support the rotary shaft 23.

The stator 21 includes a stator body 211 and a coil 212 wound around the stator body 211.

The stator body 211 is a laminated body in which a plurality of electrical steel sheets is laminated, and has an approximately cylindrical shape. A diameter of an outer circumferential surface of the stator body 211 is formed greater than a diameter of an inner circumferential surface of the central casing 31 of the casing 30 which is described later. The stator body 211 (stator 21) is forcedly inserted to the central casing 31. A method for inserting the stator body 211 to the central casing 31 may employ shrink fitting or press fitting method Further, the stator body 211 has a plurality of teeth in the circumferential direction on the inner side portion facing the outer circumference of the rotor 22. The coil 212 is arranged in a slot formed between adjacent tooth. In the stator 21 according to the embodiment, a concentrated winding, in which the coil 212 is inserted into a slot placed between a plurality of adjacent tooth, is described as an example of the coil 212 of the stator 21.

The rotor 22 is a laminated body in which a plurality of electrical steel sheets having a ring shape is laminated, and has an approximately cylindrical shape. A diameter of an inner circumferential surface of the rotor 22 is formed less than the diameter of an outer circumferential surface of the rotary shaft 23. The rotor 22 is forcedly inserted to the rotary shaft 23. A method for inserting the rotor 22 to the rotary shaft 23 may employ the press fitting method. The rotor 22 is fixed to the rotary shaft 23 and rotates together with the rotary shaft 23. Further, a rotor in which a permanent magnet is embedded therein is described as an example of the rotor 22.

Because the diameter of the outer circumferential surface of the rotor 22 is less than the diameter of the inner circumferential surface of the stator body 211 of the stator 21, a gap is formed between the rotor 22 and the stator 21.

The rotary shaft 23 includes a main shaft 231 to which the rotor 22 is coupled, and the eccentric shaft 232 provided on the upper portion of the main shaft 231 and having an axis eccentric from the axis of the main shaft 231.

The lower portion of the main shaft 231 is rotatably supported by the support member 24 and the upper portion of the main shaft 231 is rotatably supported by the frame 13 of the compression portion 10. The eccentric shaft 232 is rotatably supported by the cylindrical portion 123 of the orbiting scroll 12.

The rotary shaft 23 is provided with a through hole 233 configured to pass through the rotary shaft 23 in the axial direction. In the rotary shaft 23, a first communication hole 234 configured to allow the through hole 233 to communicate with the bearing of the support member 24, a second communication hole 235 configured to allow the through hole 233 to communicate with the bearing of the frame 13, and a third communication hole 236 configured to allow the through hole 233 to communicate with the bearing of the cylindrical portion 123 are formed in the radial direction.

The support member 24 includes a first cylindrical portion 241 having a cylindrical shape, and a second cylindrical portion 242 extending downward from the lower end of the first cylindrical portion 241 to have a cylindrical shape. The support member 24 is fixed to the central casing 31 such a way that an outer circumferential surface of the first cylindrical portion 241 is fixed to an inner circumferential surface of the central casing 31 of the casing 30 which is described later. In addition, the rotary shaft 23 is inserted into the inside of the first cylindrical portion 241 and the second cylindrical portion 242 using a journal bearing. As mentioned above, the support member 24 functions as a bearing for rotatably supporting the rotary shaft 23.

In addition, in the first cylindrical portion 241, a hole or a groove configured to allow an upper space than the first cylindrical portion 241 to communicate with a lower space than the first cylindrical portion 241 is formed.

A pump 243 configured to pump the lubricant is mounted to the lower end of the second cylindrical portion 242 of the support member 24.

Next, the casing 30 will be described.

The casing 30 includes the central casing 31 arranged in the center in the vertical direction and having a cylindrical shape, an upper casing 32 configured to cover an upper opening of the central casing 31, and a lower casing 33 configured to cover a lower opening of the central casing 31. Further, the casing 30 includes a discharge portion 34 configured to discharge the high pressure refrigerant compressed by the compression portion 10 to the outside of the casing 30, and a suction portion 35 configured to suction the refrigerant from the outside of the casing 30.

The frame 13 of the compression portion 10 and the stator 21 and the support member 24 of the drive motor 20 are fixed to the central casing 31 as described above. The discharge portion 34 and the suction portion 35 are formed by inserting a pipe into a through hole formed in the central casing 31. The suction portion 35 is installed at a position corresponding to the through the hole 111*a* formed in the cylindrical portion 111 of the fixed scroll 11. The suction portion 35 suctions the refrigerant from the outside of the casing 30 into the space surrounded by the fixed scroll 11 and the orbiting scroll 12.

The lower casing 33 is formed in a bowl shape, thereby collecting the lubricant. According to the embodiment of the disclosure, the lower case 33 is described as an example of the oil tray configured to collect the lubricant.

Next, the operation of the scroll compressor 1 will be described.

When the drive motor 20 of the scroll compressor 1 drives, the rotary shaft 23 rotates and the orbiting scroll 12 fitted in the eccentric shaft 232 of the rotary shaft 23 orbits about the fixed scroll 11. As the orbiting scroll 12 orbits about the fixed scroll 11, the low-pressure refrigerant is suctioned from the outside of the casing 30 into the space surrounded by the fixed scroll 11 and the orbiting scroll 12 through the suction portion 35. The refrigerant is compressed in accordance with the volume change of the compression chamber 15. The high-pressure refrigerant compressed in the compression chamber 15 is discharged to the lower side of the compression portion 10.

The high-pressure refrigerant discharged to the lower side of the compression portion 10 is discharged to the outside of the casing 30 through the discharge portion 34 provided in the casing 30. In the process of being discharged to the outside of the casing 30, the high-pressure refrigerant passes the gap between the rotor 22 and the stator 21 and the gap between the stator 21 and the central casing 31. The high-pressure refrigerant discharged to the outside of the casing 30 is suctioned from the suction portion 35 again after each operation of condensation, expansion and evaporation in the refrigerant circuit.

On the other hand, the lubricant collected in the lower casing 33 of the casing 30 is pumped up by the pump 243 and raised through the through hole 233 formed in the rotary shaft 23. The raised lubricant is supplied to each bearing of the rotary shaft 23 through the first communication hole 234, the second communication hole 235 and the third communication hole 236 formed in the rotary shaft 23, or is supplied to a sliding portion of the compression portion 10 through the oil passage 133 and the oil passage 115. The lubricant, which is supplied to the sliding portion of the compression portion 10 or the lubricant supplied to the bearing of the rotary shaft 23 through the first communication hole 234, the second communication hole 235, and the third communication hole 236, is returned to the lower casing 33 through the communication hole and the groove formed in the frame 13, the gap between the rotor 22 and the stator 21, and the axial direction hole formed in the support member 24, and then collected in the lower portion of the casing 30. In this process and in the process in which the high-pressure refrigerant passes the gap between the rotor 22 and the stator 21 before being discharged to the outside of the casing 30, the lubricant and the refrigerant flow into the low pressure side while cooling the drive motor 20. The lubricant, which is delivered together with the high pressure refrigerant, is separated from the refrigerant and then collected in the lower portion of the casing 30.

Figure 2:
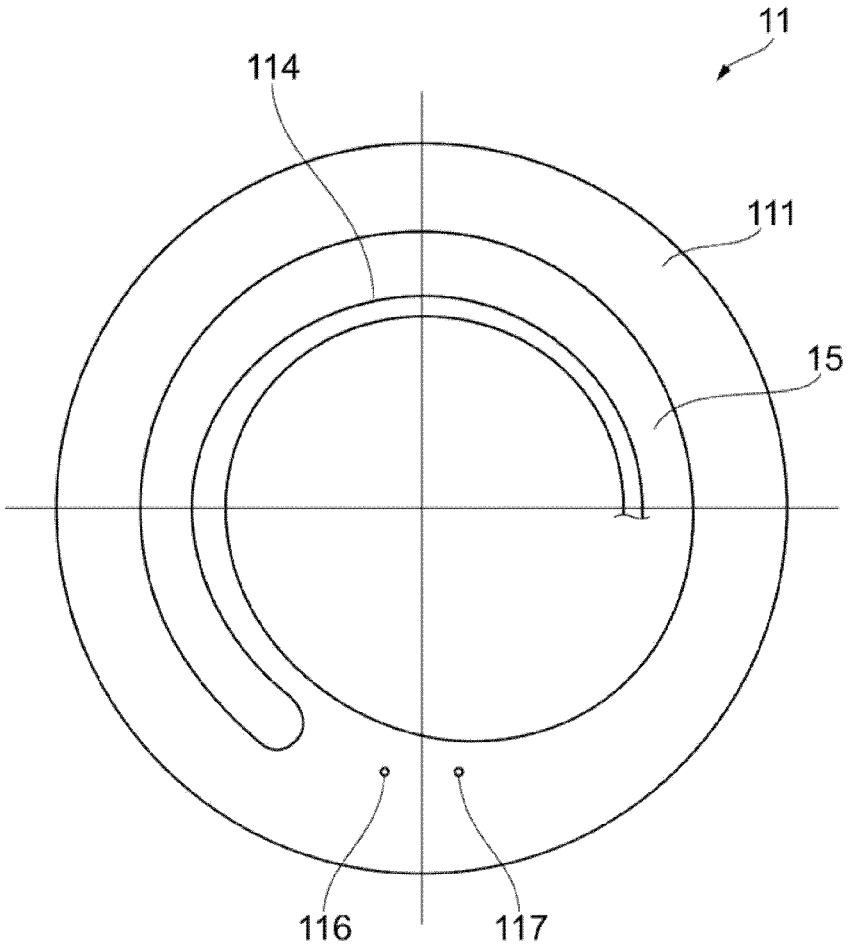
FIG. 2 is a view illustrating a basic configuration of a fixed scroll.

FIG. 2 is a view illustrating a basic configuration of the fixed scroll 11. FIG. 2 is a view of the fixed scroll 11 when viewed from above, and for convenience of description, FIG. 2 illustrates the fixed side spiral body 114 and the outlet of the oil passage 115 which are generally not shown.

As mentioned above, the fixed scroll 11 includes the fixed side spiral body 114, and the compression chamber 15 is formed between the cylindrical portion 111 and the fixed side spiral body 114.

In addition, because FIG. 1 is a longitudinal cross-sectional view of the scroll compressor 1, one outlet of the oil passage 115 is shown, but in this example, a first outlet 116 and a second outlet 117, which correspond to the outlet of the oil passage 115, are formed in the fixed scroll 11. For example, in the fixed scroll 11, the oil passage 115 may be branched into two branches and then connected to the first outlet 116 and the second outlet 117, respectively. FIG. 1 illustrates that the lubricant flows into the first outlet 116 and the second outlet 117 after the lubricant is pumped from the lower casing 33 by the pump 243, but alternatively, the lubricant may flow to the first outlet 116 and the second outlet 117 due to differential pressure. Further, the first outlet 116 is an example of a first outlet, and the second outlet 117 is an example of a second outlet.

Figure 3:
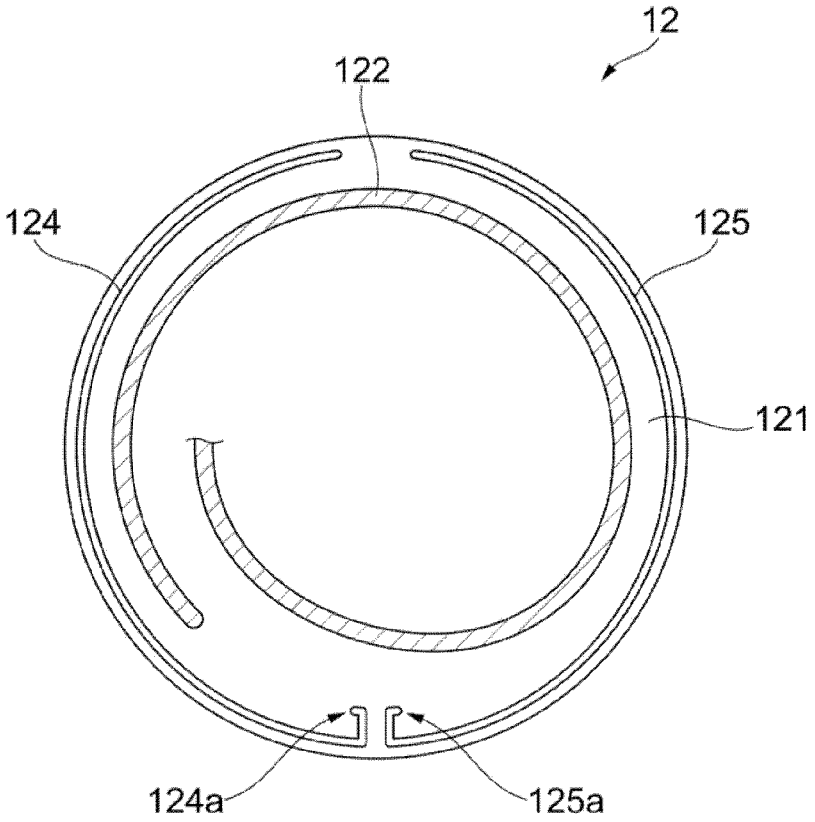
FIG. 3 is a view illustrating a basic configuration of an orbiting scroll.

FIG. 3 is a view illustrating a basic configuration of the orbiting scroll 12. FIG. 3 is a view of the orbiting scroll 12 when viewed from above.

As mentioned above, the orbiting scroll 12 includes the orbiting side spiral body 122.

In addition, the first oil groove 124 and the second oil groove 125 having a semicircular shape and configured not to communicate with each other, are installed in the end plate 121, which corresponds to the sliding surface, along an outer circumference of the end plate 121. At this time, a first groove end 124*a* of the first oil groove 124 and a second groove end 125*a* of the second oil groove 125, which serve as an inlet of the lubricant, may be installed at a position in which the first groove end 124*a* and the second groove end 125*a* communicate with the first outlet 116 and the second outlet 117, respectively by one time while the orbiting scroll 12 rotates once. Alternatively, the first groove end 124*a* and the second groove end 125*a* may be installed at a position in which the first groove end 124*a* and the second groove end 125*a* do not communicate with the first outlet 116 and the second outlet 117, respectively by one time while the orbiting scroll 12 rotates once. Alternatively, the first groove end 124*a* of the first oil groove 124 and the second groove end 125*a* of the second oil groove 125 may be installed at a position in which the first groove end 124*a* communicates with the first outlet 116 and the second groove end 125*a* does not communicate with any outlet at a predetermined timing while the orbiting scroll 12 rotates once or at a position in which the second groove end 125*a* communicates with the second outlet 117 and the first groove end 124*a* does not communicate with any outlet at a predetermined timing while the orbiting scroll 12 rotates once. The first oil groove 124 is an example of a first oil groove, and the second oil groove 125 is an example of a second oil groove.

However, the shapes of the groove end portion 124*a* and the groove end portion 125*a* in FIG. 3 are only examples, and are not limited thereto.

A positional relationship between the fixed scroll 11 and orbiting scroll 12 when the orbiting scroll 12 orbits in engagement with the fixed scroll 11 according to the first embodiment will be described with reference to FIGS. 4 to 7. In addition, in FIGS. 4 to 7, a member of the fixed scroll 11 is illustrated in bold lines to be easily distinguished from a member of the orbiting scroll 12.

Figure 4:
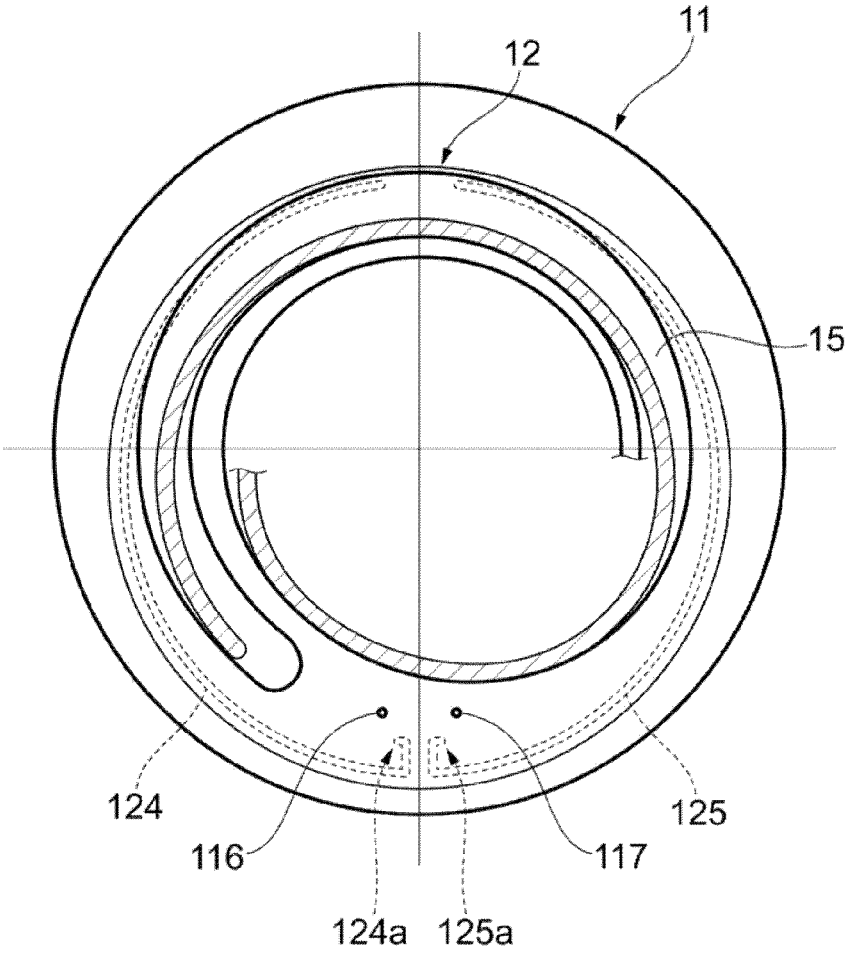
FIG. 4 is a view illustrating a state in which an orbiting scroll is pressed downward with respect to a fixed scroll according to a first embodiment of the disclosure.

FIG. 4 is a view illustrating a state in which the orbiting scroll 12 is pressed in the lower side of the drawings with respect to the fixed scroll 11. In this case, the first groove end 124*a* of the first oil groove 124 and the second groove end 125*a* of the second oil groove 125 do not communicate with any one of the first outlet 116 and the second outlet 117. Therefore, even when a part of the first oil groove 124 and the second oil groove 125 is separated from the sliding surface of the fixed scroll 11 and then communicates with the compression chamber 15, the lubricant may not flow from the first oil groove 124 and the second oil groove 125 to the compression chamber 15. That is, even when a part of the first oil groove 124 and the second oil groove 125 communicates with the compression chamber 15, the performance of the scroll compressor 1 may not be reduced.

Figure 5:
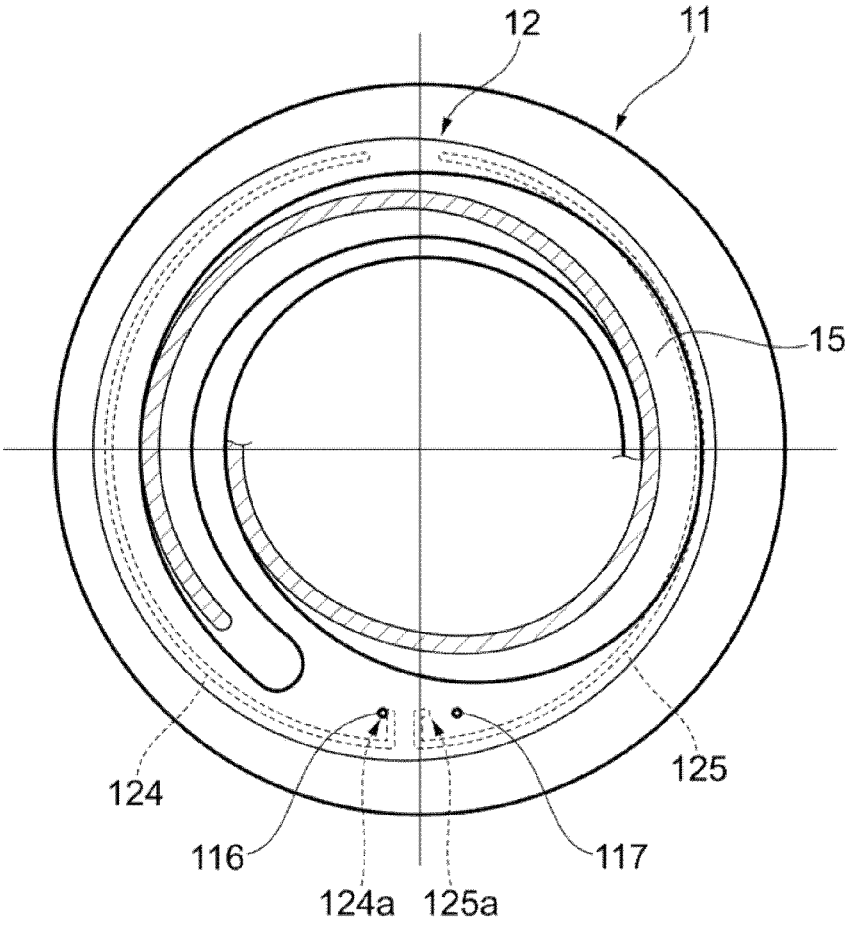
FIG. 5 is a view illustrating a state in which the orbiting scroll is pressed in the left direction with respect to the fixed scroll according to the first embodiment of the disclosure.

FIG. 5 is a view illustrating a state in which the orbiting scroll 12 is pressed in the left side of the drawings with respect to the fixed scroll 11. In this case, the first groove end 124*a* of the first oil groove 124 communicates with the first outlet 116. Therefore, the first oil groove 124 is sealed on the sliding surface of the fixed scroll 11, and does not communicate with the compression chamber 15. On the other hand, the second groove end 125*a* of the second oil groove 125 does not communicate with the second outlet 117. Therefore, even when a part of the second oil groove 125 is separated from the sliding surface of the fixed scroll 11 and then communicates with the compression chamber 15, the lubricant may not flow from the second oil groove 125 to the compression chamber 15. That is, even when a part of the second oil groove 125 communicates with the compression chamber 15, the performance of the scroll compressor 1 may not be reduced. The state shown in FIG. 5 is an example of a first state in which the first oil groove communicates with the first outlet and the second oil groove does not communicate with any outlet.

Figure 6:
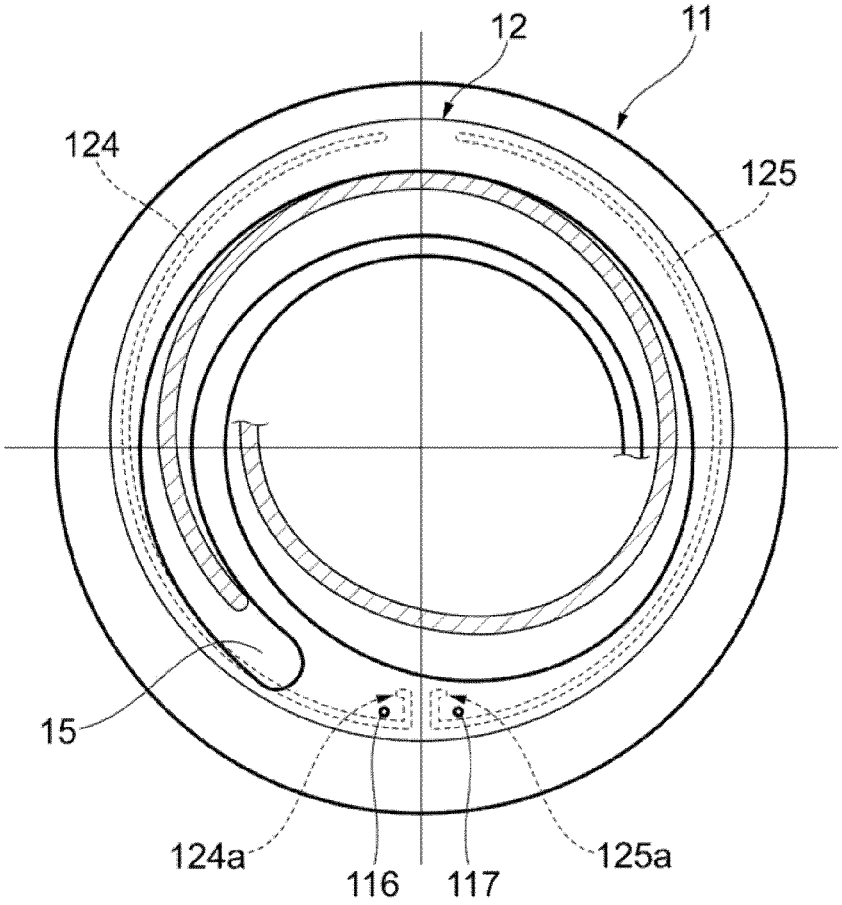
FIG. 6 is a view illustrating a state in which the orbiting scroll is pressed upward with respect to the fixed scroll according to the first embodiment of the disclosure.

FIG. 6 is a view illustrating a state in which the orbiting scroll 12 is pressed in the upper side of the drawings with respect to the fixed scroll 11. In this case, the first groove end 124*a* of the first oil groove 124 and the second groove end 125*a* of the second oil groove 125 do not communicate with any one of the first outlet 116 and the second outlet 117. Therefore, even when a part of the first oil groove 124 and the second oil groove 125 is separated from the sliding surface of the fixed scroll 11 and then communicates with the compression chamber 15, the lubricant may not flow from the first oil groove 124 and the second oil groove 125 to the compression chamber 15. That is, even when a part of the first oil groove 124 and the second oil groove 125 communicates with the compression chamber 15, the performance of the scroll compressor 1 may not be reduced.

Figure 7:
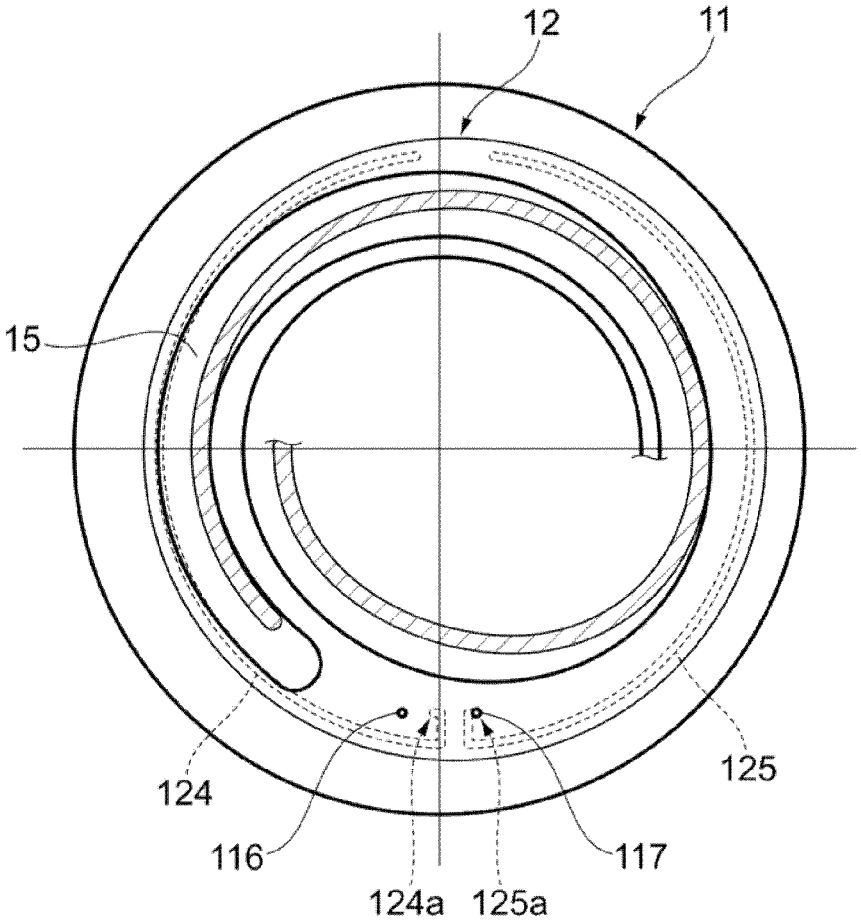
FIG. 7 is a view illustrating a state in which the orbiting scroll is pressed in the right direction with respect to the fixed scroll according to the first embodiment of the disclosure.

FIG. 7 is a view illustrating a state in which the orbiting scroll 12 is pressed in the right side of the drawings with respect to the fixed scroll 11. In this case, the second groove end 125*a* of the second oil groove 125 communicates with the second outlet 117. Therefore, the second oil groove 125 is sealed by the sliding surface of the fixed scroll 11, and does not communicate with the compression chamber 15. On the other hand, the first groove end 124*a* of the first oil groove 124 does not communicate with the first outlet 116. Therefore, even when a part of the first oil groove 124 is separated from the sliding surface of the fixed scroll 11 and then communicates with the compression chamber 15, the lubricant may not flow from the first oil groove 124 to the compression chamber 15. That is, even when a part of the first oil groove 124 communicates with the compression chamber 15, the performance of the scroll compressor 1 may not be reduced. The state shown in FIG. 7 is an example of a second state in which the second oil groove communicates with the second outlet and the first oil groove does not communicate with any outlet.

Figure 8:
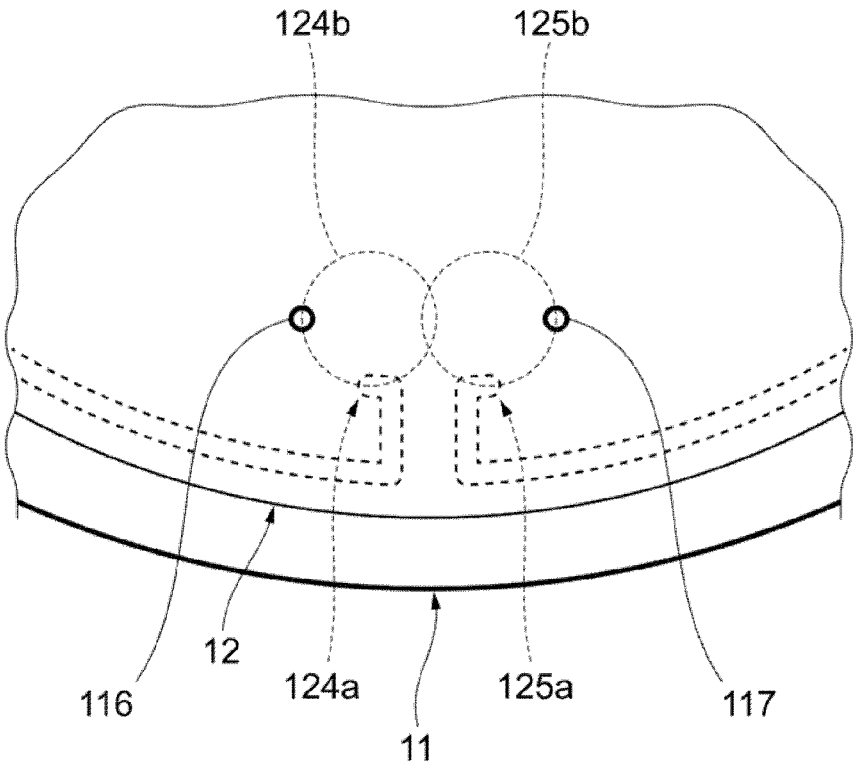
FIG. 8 is a view illustrating a positional relationship between a trajectory of two groove ends and two outputs when the orbiting scroll orbits according to the first embodiment of the disclosure.

FIG. 8 is a view illustrating a positional relationship between a trajectory 124*b* of the first groove end 124*a* and the first outlet 116, and a positional relationship between a trajectory 125*b* of the second groove end 125*a* and the second outlet 117 when the orbiting scroll 12 orbits as illustrated in FIGS. 4 to 7. In the drawing, it is seen that the first groove end 124*a* and the second groove end 125*a* respectively communicate with the first outlet 116 and the second outlet 117 once while the orbiting scroll 12 rotates once. In addition, when the first groove end 124*a* communicates with the first outlet 116, the second groove end 125*a* does not communicate the second outlet 117. On the other hand, when the second groove end 125*a* communicates with the second outlet 17, the first groove end 124*a* does not communicate the first outlet 116.

As described above, according the first embodiment, the first oil groove 124 and the second oil groove 125 which are not in communication with each other are installed in the orbiting scroll 12. Particularly, the first oil groove 124 and the second oil groove 125 have a semi-ring shape, in which a ring is divided into two pieces, rather than a ring shape.

Accordingly, because one oil groove is shortened, it is easy to deliver the lubricant from the groove end to the groove end.

In addition, according to the first embodiment, a timing, in which the first oil groove 124 and the second oil groove 125 installed in the orbiting scroll 12 communicate with the outlet of the oil passage 115 installed in the fixed scroll 11, may be set appropriately. Particularly, the first oil groove 124 and the second oil groove 125 are not always in communication with the outlet of the oil passage 115. However, the first oil groove 124 and the second oil groove 125 communicate with the outlet of the oil passage 115 at a timing, in which the first oil groove 124 and the second oil groove 125 do not communicates with the compression chamber 15, while the orbiting scroll 12 orbits. Therefore, even when the sliding portion becomes narrower because the diameter of the orbiting scroll 12 is reduced, it is possible to sufficiently supply the lubricant and thus it is possible to improve the sealing force and lubricity of the sliding portion. As a result, it is possible to descrease the diameter of the orbiting scroll 12 and a diameter of the main body of the scroll compressor 1. In other words, because it is possible to increase the suction volume in the scroll compressor 1 having the same body diameter, it is possible to reduce the size of the scroll compressor 1 while increasing the capacity of the scroll compressor 1. Further, according to the first embodiment, the first outlet 116 and the second outlet 117 are provided in the fixed scroll 11 as the outlet of the oil passage 115, but is not limited thereto. Therefore, a single outlet of the oil passage 115 may be provided. For example, a large hole including the first outlet 116 and the second outlet 117 may be provided as long as that does not interfere with the state transitions shown in FIGS. 4 to 7, and the large hole may be used as an outlet of the oil passage.

Further, according to the first embodiment, the orbiting scroll 12 is provided with two oil grooves which do not communicate with each other, but is not limited thereto. In other words, the orbiting scroll 12 may be provided with a plurality of oil grooves which do not communicate with each other.

In this case, each oil groove of the plurality of oil grooves may be installed to communicate with the outlet of the oil passage 115 at least once and not to communicate with the outlet of the oil passage 115 at least once while the orbiting scroll 12 rotates once. In addition, as for each oil groove of the plurality of oil grooves, one oil groove may be installed to communicate with the outlet of the oil passage 115 during the time in which at least one oil groove except the one oil groove does not communicate with the outlet of the oil passage 115.

In other words, the plurality of oil grooves may be installed in such a way that at least one oil groove communicates with the outlet of the oil passage 115 and the other at least one oil groove does not communicate with the outlet of the oil passage 115 at a predetermined timing while the orbiting scroll 12 rotates once.

In addition, according to the first embodiment, the outlet of the oil passage 115 is provided on the fixed scroll 11, and the plurality of oil grooves is provided on the orbiting scroll 12, but is not limited thereto. Therefore, the plurality of oil grooves may be provided on the fixed scroll 11, and the outlet of the oil passage 115 may be provided on the orbiting scroll 12.

Even in this case, each oil groove of the plurality of oil grooves may be installed to communicate with the outlet of the oil passage 115 at least once and not to communicate with the outlet of the oil passage 115 at least once while the orbiting scroll 12 rotates once. In addition, as for each oil groove of the plurality of oil grooves, one oil groove may be installed to communicate with the outlet of the oil passage 115 during the time in which at least one oil groove except the one oil groove does not communicate with the outlet of the oil passage 115.

In other words, the plurality of oil grooves may be installed in such a way that at least one oil groove communicates with the outlet of the oil passage 115 and the other at least one oil groove does not communicate with the outlet of the oil passage 115 at a predetermined timing while the orbiting scroll 12 rotates once.

Between the first oil groove 124 and the second oil groove 125, one of thereof communicating with the outlet of the oil passage 115 is sealed by the sliding surface of the fixed scroll 11 so as to form a thrust sliding portion. In this configuration, when the through hole 233 connected to the lower casing 33, which is the oil tray of the high-pressure refrigerants, communicates with the first oil groove 124 and the second oil groove 125 through the oil passage 133 and the oil passage 115, the first oil groove 124 and the second oil groove 125 may be filled with the high-pressure lubricant and the lubricant may flow to a gap of several micrometers between the trust sliding portions, thereby improving the lubrication of the thrust sliding portion.

However, when the first oil groove 124 and the second oil groove 125 are close to the compression chamber 15, a large amount of the lubricant may flow from the first oil groove 124 and the second oil groove 125 to the compression chamber 15 and thus the performance may be reduced.

Therefore, according to the second embodiment, it is possible to prevent the lubricant from leaking to the compression chamber 15 by adjusting a distance from the first oil groove 124 and the second oil groove 125 to the compression chamber 15 and the communication relationship between the first outlet 116 and the second outlet 117.

The positional relationship between the fixed scroll 11 and the orbiting scroll 12, when the orbiting scroll 12 orbits in engagement with the fixed scroll 11 according to the second embodiment, will be described with reference to FIGS. 9 to 16. Particularly, it illustrates the distance (seal length) from the first oil groove 124 and the second oil groove 125 to the compression chamber 15 and the communication relationship between the first oil groove 124 and the second oil groove 125 and the first outlet 116 and the second outlet 117 when the orbiting scroll 12 orbits at each 4520 clockwise. In addition, in FIGS. 9 to 16, a member of the fixed scroll 11 is illustrated in bold lines to be easily distinguished from a member of the orbiting scroll 12.

Figure 9:
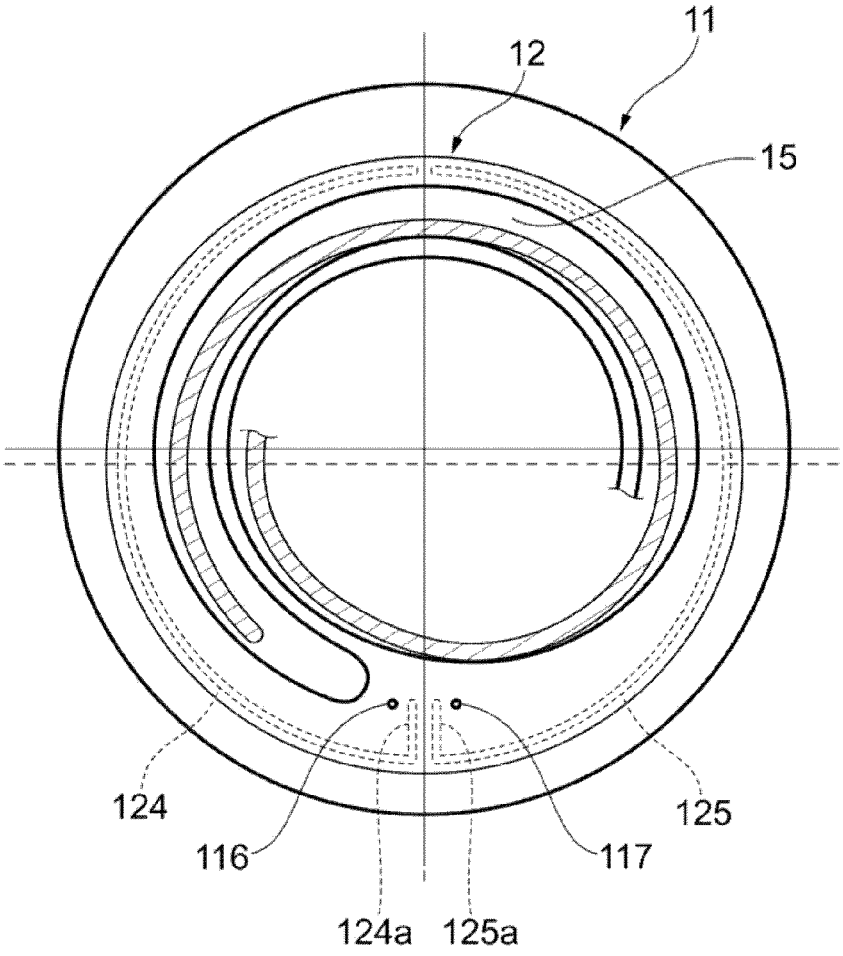
FIG. 9 is a view illustrating a state in which an orbiting scroll is pressed downward with respect to a fixed scroll according to a second embodiment of the disclosure.

FIG. 9 is a view illustrating a state in which the orbiting scroll 12 is pressed in the lower side of the drawings with respect to the fixed scroll 11. In this case, the first groove end 124*a* of the first oil groove 124 and the second groove end 125*a* of the second oil groove 125 do not communicate with any one of the first outlet 116 and the second outlet 117. Therefore, even when the first oil groove 124 and the second oil groove 125 approaches the compression chamber 15, the lubricant may not leak from the first oil groove 124 and the second oil groove 125 to the compression chamber 15.

Figure 10:
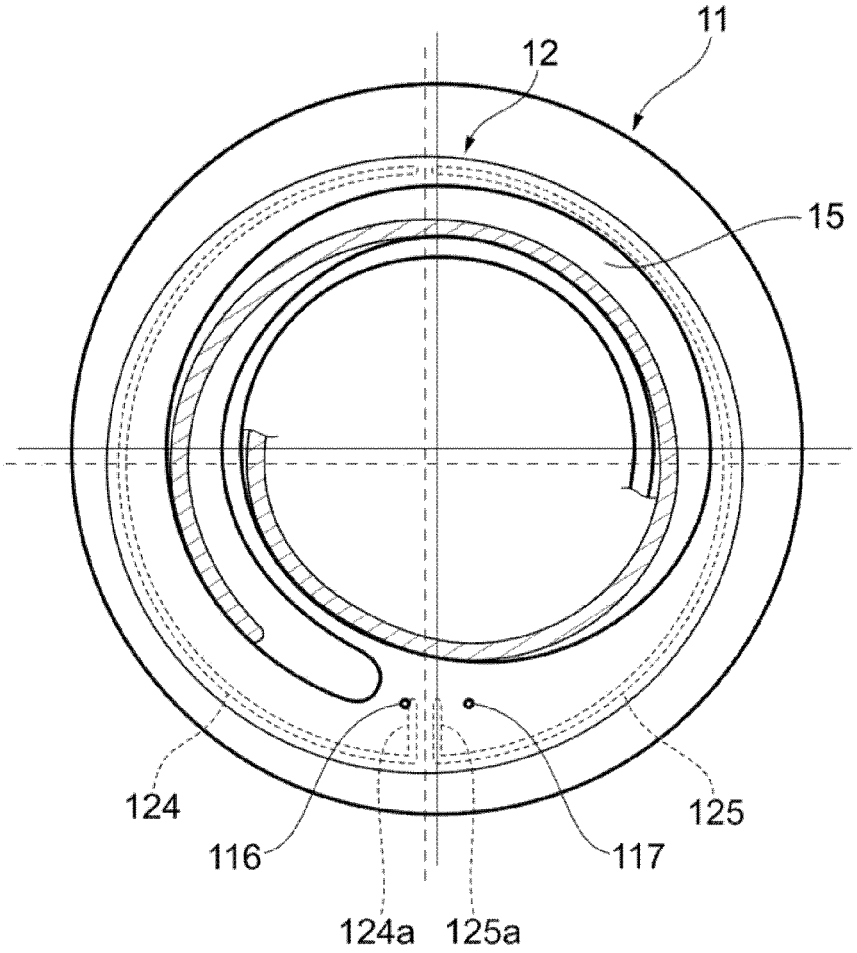
FIG. 10 is a view illustrating a state in which the orbiting scroll is pressed in the lower left direction with respect to the fixed scroll according to the second embodiment of the disclosure.

FIG. 10 is a view illustrating a state in which the orbiting scroll 12 is pressed in the lower left side of the drawings with respect to the fixed scroll 11. In this case, the first groove end 124*a* of the first oil groove 124 starts to communicate with the first outlet 116. Therefore, as illustrated, the rear of the first oil groove 124 in the orbit direction is separated from the compression chamber 15. Meanwhile, in this case, the second groove end 125*a* of the second oil groove 125 does not communicate with the second outlet 117. Therefore, as illustrated, even when the second oil groove 125 approaches the compression chamber 15, the lubricant may not leak from the second oil groove 125 to the compression chamber 15. The state shown in FIG. 10 is an example of a first state in which the first oil groove communicates with the first outlet and the second oil groove does not communicate with any outlet.

Figure 11:
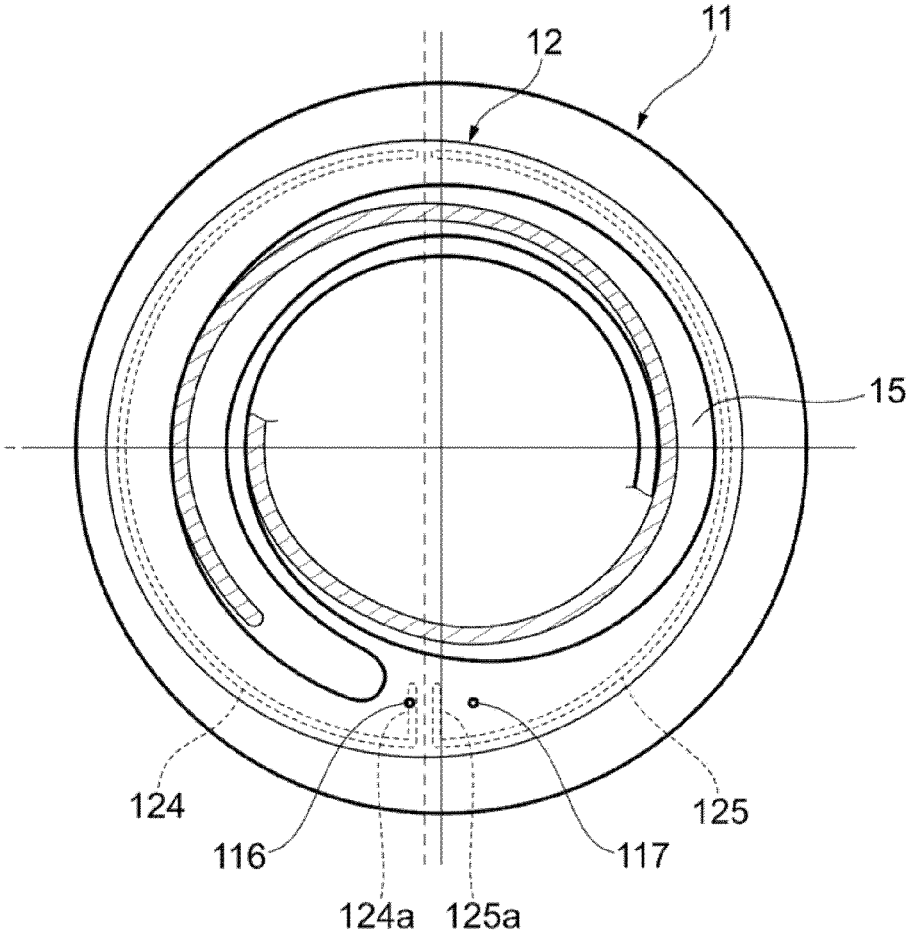
FIG. 11 is a view illustrating a state in which the orbiting scroll is pressed in the left direction with respect to the fixed scroll according to the second embodiment of the disclosure.

FIG. 11 is a view illustrating a state in which the orbiting scroll 12 is pressed in the left side of the drawings with respect to the fixed scroll 11. In this case, the first groove end 124*a* of the first oil groove 124 communicates with the first outlet 116. Therefore, as illustrated, the first oil groove 124 is separated from the compression chamber 15. Meanwhile, in this case, the second groove end 125*a* of the second oil groove 125 does not communicate with the second outlet 117. Therefore, as illustrated, even when the second oil groove 125 approaches the compression chamber 15, the lubricant may not leak from the second oil groove 125 to the compression chamber 15. The state shown in FIG. 11 is an example of the first state in which the first oil groove communicates with the first outlet and the second oil groove does not communicate with any outlet.

Figure 12:
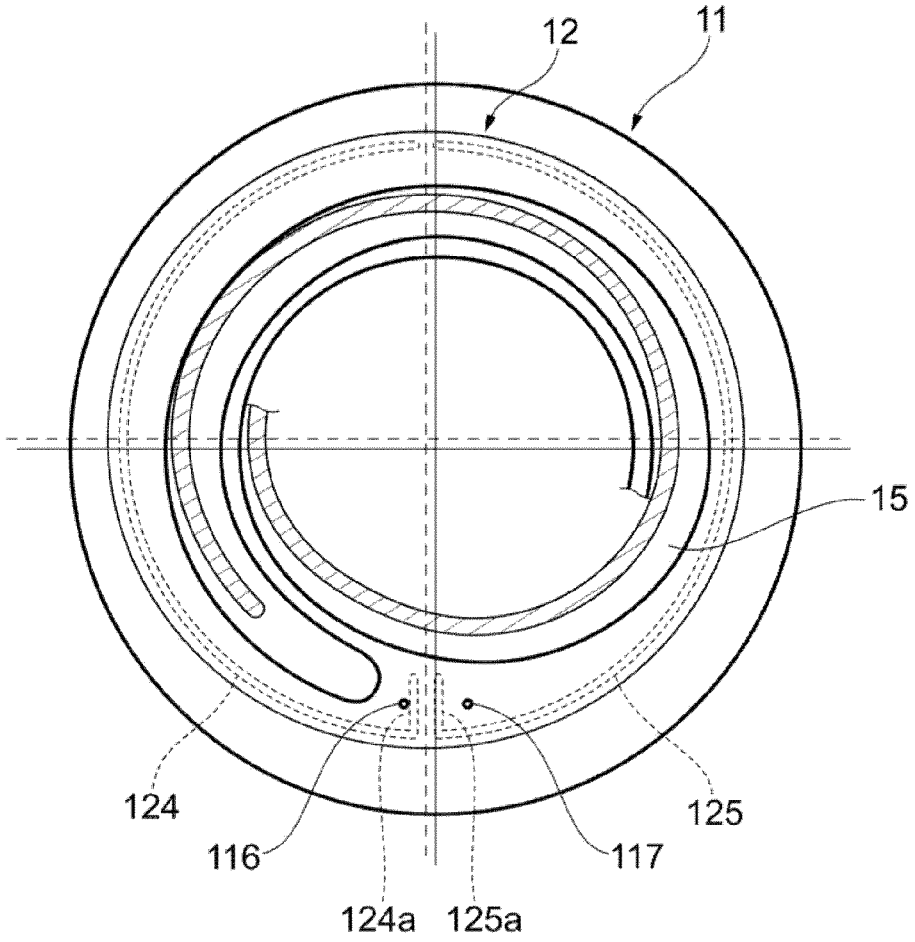
FIG. 12 is a view illustrating a state in which the orbiting scroll is pressed in the upper left direction with respect to the fixed scroll according to the second embodiment of the disclosure.

FIG. 12 is a view illustrating a state in which the orbiting scroll 12 is pressed in the upper left side of the drawings with respect to the fixed scroll 11. In this case, the communication between the first groove end 124*a* of the first oil groove 124 and the first outlet 116 is ending. Therefore, as illustrated, the front of the first oil groove 124 in the orbit direction is separated from the compression chamber 15. Meanwhile, in this case, the second groove end 125*a* of the second oil groove 125 does not communicate with the second outlet 117. Therefore, as illustrated, even when the second oil groove 125 approaches the compression chamber 15, the lubricant may not leak from the second oil groove 125 to the compression chamber 15. The state shown in FIG. 12 is an example of the first state in which the first oil groove communicates with the first outlet and the second oil groove does not communicate with any outlet.

Figure 13:
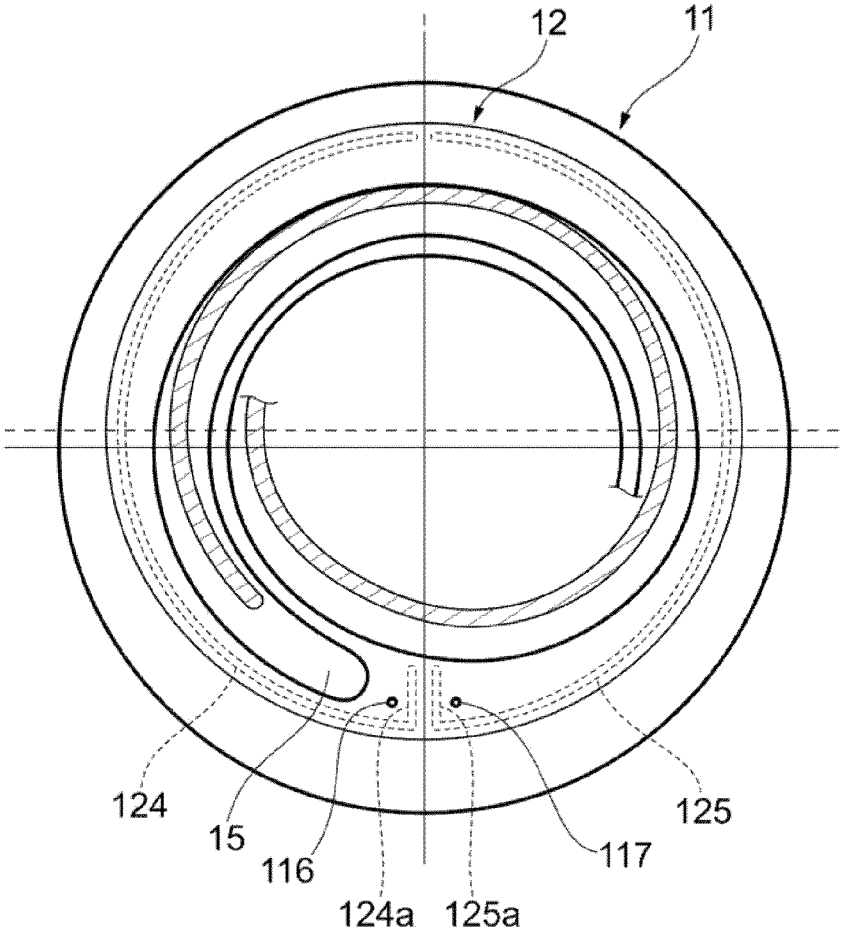
FIG. 13 is a view illustrating a state in which the orbiting scroll is pressed upward with respect to the fixed scroll according to the second embodiment of the disclosure.

FIG. 13 is a view illustrating a state in which the orbiting scroll 12 is pressed in the upper side of the drawings with respect to the fixed scroll 11. In this case, the first groove end 124*a* of the first oil groove 124 and the second groove end 125*a* of the second oil groove 125 do not communicate with any one of the first outlet 116 and the second outlet 117. Therefore, even when the first oil groove 124 and the second oil groove 125 approaches the compression chamber 15, the lubricant may not leak from the first oil groove 124 and the second oil groove 125 to the compression chamber 15.

Figure 14:
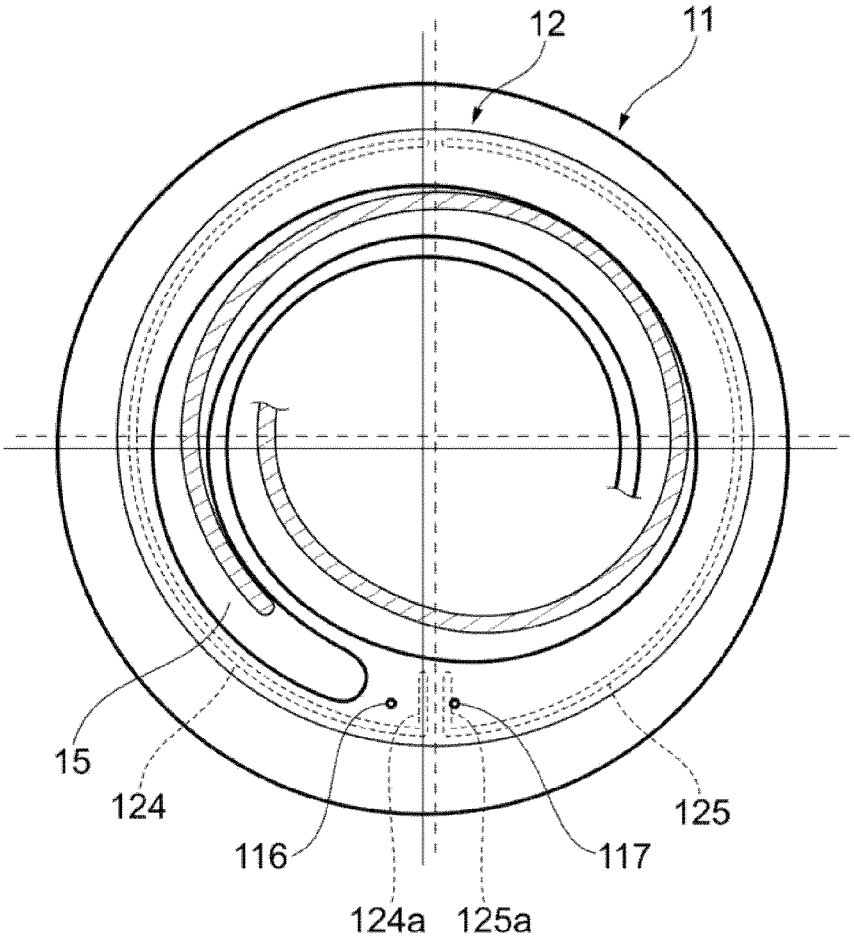
FIG. 14 is a view illustrating a state in which the orbiting scroll is pressed in the upper right direction with respect to the fixed scroll according to the second embodiment of the disclosure.

FIG. 14 is a view illustrating a state in which the orbiting scroll 12 is pressed in the upper right side of the drawings with respect to the fixed scroll 11. In this case, the second groove end 125*a* of the second oil groove 125 starts to communicate with the second outlet 117. Therefore, as illustrated, the rear of the second oil groove 125 in the orbit direction is separated from the compression chamber 15. Meanwhile, in this case, the first groove end 124*a* of the first oil groove 124 does not communicate with the first outlet 116. Therefore, as illustrated, even when the first oil groove 124 approaches the compression chamber 15, the lubricant may not leak from the first oil groove 124 to the compression chamber 15. The state shown in FIG. 14 is an example of a second state in which the second oil groove communicates with the second outlet and the first oil groove does not communicate with any outlet.

Figure 15:
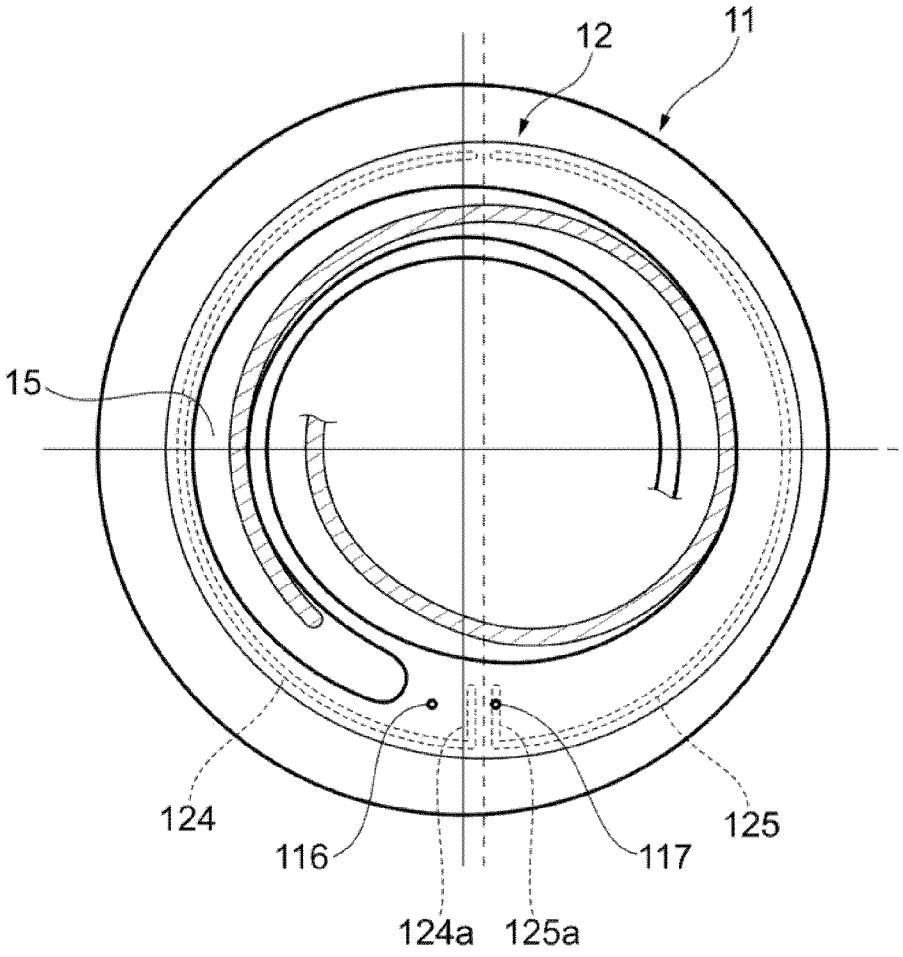
FIG. 15 is a view illustrating a state in which the orbiting scroll is pressed in the right direction with respect to the fixed scroll according to the second embodiment of the disclosure.

FIG. 15 is a view illustrating a state in which the orbiting scroll 12 is pressed in the right side of the drawings with respect to the fixed scroll 11. In this case, the second groove end 125*a* of the second oil groove 125 communicates with the second outlet 117. Therefore, as illustrated, the second oil groove 125 is separated from the compression chamber 15. On the other hand, in this case, the first groove end 124*a* of the first oil groove 124 does not communicate with the first outlet 116. Accordingly, as illustrated, even when the first oil groove 124 approaches the compression chamber 15, the lubricant may not leak from the first oil groove 124 to the compression chamber 15. The state shown in FIG. 15 is an example of the second state in which the second oil groove communicates with the second outlet and the first oil groove does not communicate with any outlet.

Figure 16:
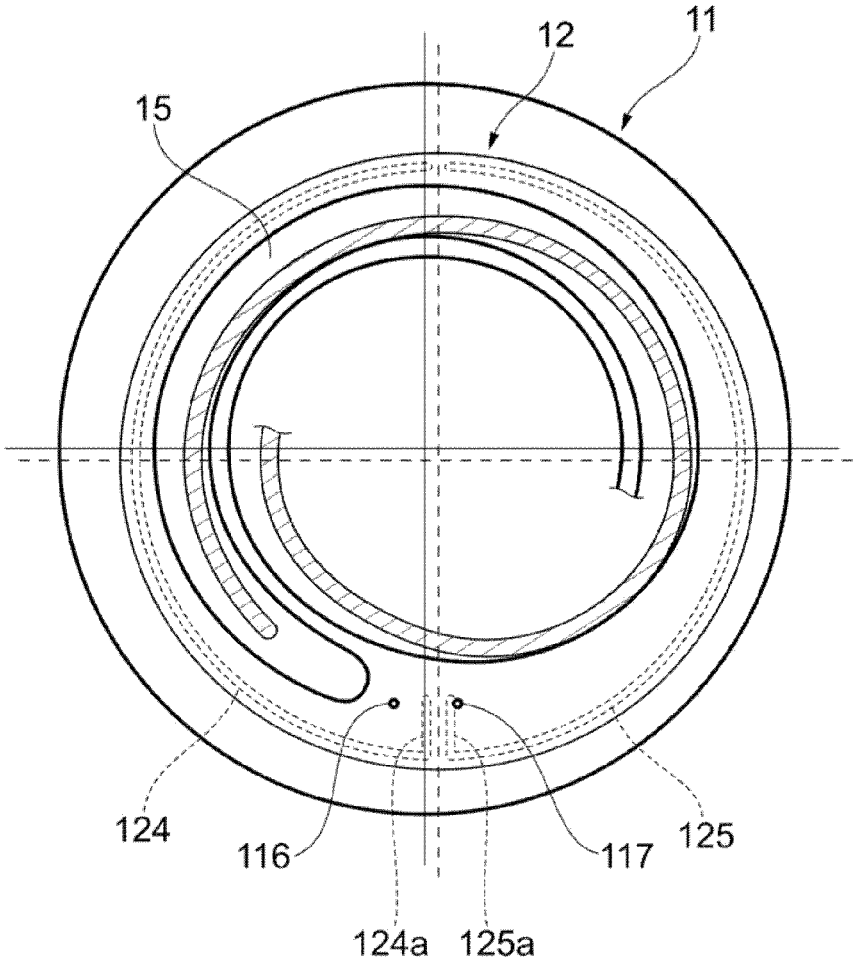
FIG. 16 is a view illustrating a state in which the orbiting scroll is pressed in the lower right direction with respect to the fixed scroll according to the second embodiment of the disclosure.

FIG. 16 is a view illustrating a state in which the orbiting scroll 12 is pressed in the lower right side of the drawings with respect to the fixed scroll 11. In this case, the communication between the second groove end 125*a* of the second oil groove 125 and the second outlet 117 is ending. Therefore, as illustrated, the front of the second oil groove 125 in the orbit direction is separated from the compression chamber 15. On the other hand, in this case, the first groove end 124*a* of the first oil groove 124 does not communicate with the first outlet 116. Therefore, as illustrated, even when the first oil groove 124 approaches the compression chamber 15, the lubricant may not leak from the first oil groove 124 to the compression chamber 15. The state shown in FIG. 16 is an example of the second state in which the second oil groove communicates with the second outlet and the first oil groove does not communicate with any outlet.

As mentioned above, according to the second embodiment, one of the first oil groove 124 and the second oil groove 125 that approaches the compression chamber 15 does not communicate with the first outlet 116 and the second outlet 117. Accordingly, it is possible to prevent a large amount of the lubricant from flowing to the compression chamber 15.

Further, according to the second embodiment, the first outlet 116 and the second outlet 117 are provided in the fixed scroll 11 as the outlet of the oil passage 115, but is not limited thereto. Therefore, a single outlet of the oil passage 115 may be provided. For example, a large hole including the first outlet 116 and the second outlet 117 may be provided as long as that does not interfere with the state transitions shown in FIGS. 9 to 16, and the large hole may be used as an outlet of the oil passage.

Further, according to the second embodiment, the orbiting scroll 12 is provided with two oil grooves which do not communicate with each other, but is not limited thereto. In other words, the orbiting scroll 12 may be provided with a plurality of oil grooves which does not communicate with each other.

In this case, each oil groove of the plurality of oil grooves may be installed to communicate with the outlet of the oil passage 115 at least once and not to communicate with the outlet of the oil passage 115 at least once while the orbiting scroll 12 rotates once. In addition, each oil groove of the plurality of oil grooves may be installed in such a way that one oil groove is installed to communicate with the outlet of the oil passage 115 during the time in which at least one oil groove except the one oil groove does not communicate with the outlet of the oil passage 115.

In addition, the plurality of oil grooves may be installed in such a way that one oil groove and at least one oil groove except the one oil groove are sealed by the sliding surface of the fixed scroll 11 and the sliding surface of the orbiting scroll 12. Further, in this case, in the configuration illustrated in FIGS. 9 to 16, a distance of a portion in which one oil groove of the plurality of oil grooves is sealed by the sliding surface of the fixed scroll 11 and the sliding surface of the orbiting scroll 12 may be greater than a distance of a portion in which at least one oil groove except the one oil groove is sealed by the sliding surface of the fixed scroll 11 and the sliding surface of the orbiting scroll 12 during the time in which at least one oil groove except the one oil groove does not communicate with the outlet of the oil passage 115.

The plurality of oil grooves may be installed in such a way that at least one oil groove communicates with the outlet of the oil passage 115 and the other one oil groove does not communicate with the outlet of the oil passage 115 at a predetermined timing while the orbiting scroll 12 rotates once.

In addition, the at least one oil groove and the other at least one oil groove may be installed to be sealed by the sliding surface of the fixed scroll 11 and the sliding surface of the orbiting scroll 12 at a predetermined timing. Further, in this case, the configuration illustrated in FIGS. 9 to 16, a distance of a portion in which at least one oil groove of the plurality of oil grooves is sealed by the sliding surface of the fixed scroll 11 and the sliding surface of the orbiting scroll 12 may be greater than a distance of a portion in which the other at least one oil groove is sealed by the sliding surface of the fixed scroll 11 and the sliding surface of the orbiting scroll 12 at the predetermined timing.

In the above description, a distance to the compression chamber 15 is described as an example of the distance of a portion sealed by the sliding surface of the fixed scroll 11 and the sliding surface of the orbiting scroll 12.

Accordingly, the distance of the portion in which the at least one oil groove is sealed by the sliding surface of the fixed scroll 11 and the sliding surface of the orbiting scroll 12 may correspond to a distance from the at least one oil groove to the compression chamber 15 in the radial direction of the fixed scroll 11.

In addition, the distance of the portion in which the other at least one oil groove is sealed by the sliding surface of the fixed scroll 11 and the sliding surface of the orbiting scroll 12 may correspond to a distance from the other at least one oil groove to the compression chamber 15 in the radial direction of the fixed scroll 11. Further, according to the second embodiment, the outlet of the oil passage 115 may be provided in the fixed scroll 11 and the plurality of oil grooves may be provided in the orbiting scroll 12, but is not limited thereto. Therefore, the plurality of oil grooves may be provided in the fixed scroll 11, and the outlet of the oil passage 115 may be provided in the orbiting scroll 12.

Even in this case, each oil groove of the plurality of oil grooves may be installed to communicate with the outlet of the oil passage 115 at least once and not to communicate with the outlet of the oil passage 115 at least once while the orbiting scroll 12 rotates once. In addition, each oil groove of the plurality of oil grooves may be installed in such a way that one oil groove is installed to communicate with the outlet of the oil passage 115 during the time in which at least one oil groove except the one oil groove does not communicate with the outlet of the oil passage 115.

In addition, the plurality of oil grooves may be installed in such a way that one oil groove and at least one oil groove except the one oil groove are sealed by the sliding surface of the fixed scroll 11 and the sliding surface of the orbiting scroll 12. Further, in this case, in the configuration illustrated in FIGS. 9 to 16, a distance of a portion in which one oil groove of the plurality of oil grooves is sealed by the sliding surface of the fixed scroll 11 and the sliding surface of the orbiting scroll 12 may be greater than a distance of a portion in which at least one oil groove except the one oil groove is sealed by the sliding surface of the fixed scroll 11 and the sliding surface of the orbiting scroll 12 during the time in which at least one oil groove except the one oil groove does not communicate with the outlet of the oil passage 115.

The plurality of oil grooves may be installed in such a way that at least one oil groove communicates with the outlet of the oil passage 115 and the other at least one oil groove does not communicate with the outlet of the oil passage 115 at a predetermined timing while the orbiting scroll 12 rotates once.

In addition, the at least one oil groove and the other at least one oil groove may be installed to be sealed by the sliding surface of the fixed scroll 11 and the sliding surface of the orbiting scroll 12 at a predetermined timing. Further, in this case, the configuration illustrated in FIGS. 9 to 16, a distance of a portion in which at least one oil groove of the plurality of oil grooves is sealed by the sliding surface of the fixed scroll 11 and the sliding surface of the orbiting scroll 12 may be greater than a distance of a portion in which the other at least one oil groove is sealed by the sliding surface of the fixed scroll 11 and the sliding surface of the orbiting scroll 12 at the predetermined timing. In the above description, a distance to the intermediate pressure chamber is described as an example of the distance of a portion sealed by the sliding surface of the fixed scroll 11 and the sliding surface of the orbiting scroll 12.

Accordingly, the distance of the portion in which the at least one oil groove is sealed by the sliding surface of the fixed scroll 11 and the sliding surface of the orbiting scroll 12 may correspond to a distance from the at least one oil groove to the intermediate pressure chamber in the radial direction of the fixed scroll 11.

Further, the distance of the portion in which the other at least one oil groove is sealed by the sliding surface of the fixed scroll 11 and the sliding surface of the orbiting scroll 12 may correspond to a distance from the other at least one oil groove to the intermediate pressure chamber in the radial direction of the fixed scroll 11.

As is apparent from the above description, it is possible to make the diameter of the orbiting scroll small in comparison with a case in which an oil groove is provided in a single ring shape and constantly communicates with an outlet of an oil passage.

Although a few embodiments of the present disclosure have been shown and described, it would be appreciated by those skilled in the art that changes may be made in these embodiments without departing from the principles and spirit of the disclosure, the scope of which is defined in the claims and their equivalents.

Although the present disclosure has been described with various embodiments, various changes and modifications may be suggested to one skilled in the art. It is intended that the present disclosure encompass such changes and modifications as fall within the scope of the appended claims.

What is claimed is:

1. A scroll compressor comprising:

a fixed scroll fixed to an inside of a main body; and an orbiting scroll configured to orbit in engagement with the fixed scroll, wherein the fixed scroll comprises an outlet of an oil passage configured to communicate with an oil tray configured to store a lubricant, the outlet of the oil passage connected to a sliding surface of the orbiting scroll, wherein the orbiting scroll comprises a plurality of oil grooves configured to receive the lubricant from the oil tray through the outlet of the oil passage, each of the plurality of oil grooves configured to supply the lubricant to a sliding surface of the fixed scroll and to not communicate with another of the plurality of oil grooves, and wherein each of the plurality of oil grooves is configured to communicate with the outlet at least once and to not communicate with the outlet at least once while the orbiting scroll rotates once.

2. The scroll compressor of claim I, wherein each of the plurality of oil grooves is sealed by a sliding surface of the fixed scroll and the sliding surface of the orbiting scroll while in communication with the outlet.

3. The scroll compressor of claim 1, wherein, among the plurality of oil grooves, a first oil groove is configured to communicate with the outlet during a time in which a second oil groove is not configured to communicate with the outlet.

4. The scroll compressor of claim 3, wherein the first oil groove and the second oil groove are sealed by the sliding surface of the fixed scroll and the sliding surface of the orbiting scroll.

5. The scroll compressor of claim 4, wherein a distance of a portion in which the first oil groove is sealed by the sliding surface of the fixed scroll and the sliding surface of the orbiting scroll is greater than a distance of another portion in which the second oil groove is sealed by the sliding surface of the fixed scroll and the sliding surface of the orbiting scroll during the time in which the second oil groove is not configured to communicate with the outlet.

6. The scroll compressor of claim 4, further comprising:

a compression chamber formed between the fixed scroll and the orbiting scroll, the compression chamber having a volume that is changeable as the orbiting scroll orbits with respect to the fixed scroll, wherein a distance from the first oil groove to the compression chamber is greater than a distance from the second oil groove to the compression chamber.

7. The scroll compressor of claim 1, wherein at least a portion of each of the plurality of oil grooves extends along an outer circumference of the orbiting scroll.

8. The scroll compressor of claim 1, wherein the outlet s provided in plural in accordance with a number of the plurality of oil grooves.

9. The scroll compressor of claim 1, Therein, at a first predetermined timing while the orbiting scroll rotates once, a first oil groove of the plurality of oil grooves is configured to communicate with the outlet and a second oil groove of the plurality of oil grooves is not configured to communicate with the outlet.

10. The scroll compressor of claim 9, wherein the first oil groove and the second oil groove are sealed by the sliding surface of the fixed scroll and the sliding surface of the orbiting scroll at the first predetermined timing.

11. The scroll compressor of claim 10, wherein, at the first predetermined timing, a distance of a portion in which the first oil groove is sealed by the sliding surface of the fixed scroll and the sliding surface of the orbiting scroll is greater than a distance of another portion in which the second oil groove is sealed by the sliding surface of the fixed scroll and the sliding surface of the orbiting scroll.

12. The scroll compressor of claim 9, wherein, at a second predetermined timing while the orbiting scroll rotates once, each of the plurality of oil grooves is not configured to communicate with the outlet.

13. An air conditioner comprising:

a scroll compressor configured to compress a refrigerant;

an outdoor heat exchanger configured to exchange heat with outside air;

an expansion device configured to expand the refrigerant; and an indoor heat exchanger configured to exchange heat with indoor air, wherein the scroll compressor comprises:

a fixed scroll fixed to an inside of a main body; and an orbiting scroll configured to orbit in engagement with the fixed scroll, wherein the fixed scroll comprises an outlet of an oil passage configured to communicate with an oil tray configured to store a lubricant, the outlet of the oil passage connected to a sliding surface of the orbiting scroll, wherein the orbiting scroll comprises a plurality of oil grooves configured to receive the lubricant from the oil tray through the outlet of the oil passage, each of the plurality of oil grooves configured to supply the lubricant to a sliding surface of the fixed scroll and to not communicate with another of the plurality of oil grooves, and wherein each of the plurality of oil grooves is configured to communicate with the outlet at least once and to not communicate with the outlet at least once while the orbiting scroll rotates once.

14. The air conditioner of claim 13, wherein each of the plurality of oil grooves is sealed by a sliding surface of the fixed scroll and the sliding surface of the orbiting scroll while in communication with the outlet.

15. The air conditioner of claim 13, wherein, among the plurality of oil grooves, a first oil groove is configured to communicate with the outlet during a time in which a second oil groove is not configured to communicate with the outlet.

16. The air conditioner of claim 15, wherein the first oil groove and the second oil groove are sealed by the sliding surface of the fixed scroll and the sliding surface of the orbiting scroll.

17. The air conditioner of claim 16, wherein a distance of a portion in which the first oil groove is sealed by the sliding surface of the fixed scroll and the sliding surface of the orbiting scroll is greater than a distance of another portion in which the second oil groove is sealed by the sliding surface of the fixed scroll and the sliding surface of the orbiting scroll during the time in which the second oil groove is not configured to communicate with the outlet.

18. The air conditioner of claim 16, further comprising:

a compression chamber formed between the fixed scroll and the orbiting scroll, the compression chamber having a volume that is changeable as the orbiting scroll orbits with respect to the fixed scroll, wherein a distance from the first oil groove to the compression chamber is greater than a distance from the second oil groove to the compression chamber.

19. The air conditioner of claim 13, wherein at least a portion of each of the plurality of oil grooves extends along an outer circumference of the orbiting scroll.

20. The air conditioner of claim 13, wherein the outlet is provided in plural in accordance with a number of the plurality of oil grooves.

* * * * *